US012123262B2

(12) United States Patent
Zhang et al.

(10) Patent No.: US 12,123,262 B2
(45) Date of Patent: Oct. 22, 2024

(54) PDC CUTTER WITH ENHANCED PERFORMANCE AND DURABILITY

(71) Applicant: Schlumberger Technology Corporation, Sugar Land, TX (US)

(72) Inventors: Youhe Zhang, Spring, TX (US); Yuri Burhan, Spring, TX (US); Ke Chen, Houston, TX (US); Xiaoge Gan, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/253,602

(22) PCT Filed: Nov. 23, 2021

(86) PCT No.: PCT/US2021/060593
§ 371 (c)(1),
(2) Date: May 19, 2023

(87) PCT Pub. No.: WO2022/115465
PCT Pub. Date: Jun. 2, 2022

(65) Prior Publication Data

US 2023/0417109 A1 Dec. 28, 2023

Related U.S. Application Data

(60) Provisional application No. 63/117,694, filed on Nov. 24, 2020.

(51) Int. Cl.
*E21B 10/567* (2006.01)
*E21B 10/55* (2006.01)
*E21B 10/62* (2006.01)

(52) U.S. Cl.
CPC ..... *E21B 10/5673* (2013.01); *E21B 10/55* (2013.01); *E21B 10/62* (2013.01)

(58) Field of Classification Search
CPC ..... E21B 10/5673
See application file for complete search history.

(56) References Cited

U.S. PATENT DOCUMENTS 3,388,757 A * 6/1968 Fittinger ..... E21B 10/56 175/426
5,709,279 A * 1/1998 Dennis ..... E21B 10/5735 175/430

(Continued)

FOREIGN PATENT DOCUMENTS

CN 207420457 5/2018
CN 208203143 12/2018
WO WO-2016044136 A1 * 3/2016 ..... E21B 10/567

OTHER PUBLICATIONS

International Search Report and Written Opinion issued in International Patent application PCT/2021/060593 on Mar. 14, 2022, 9 pages.

(Continued)

*Primary Examiner* — Jennifer H Gay
(74) *Attorney, Agent, or Firm* — Jeffrey D. Frantz

(57) ABSTRACT

A cutting element has a cutting face at an axial end of the cutting element, a peripheral surface extending circumferentially around the cutting face, and a cutting edge formed between the cutting face and the peripheral surface. The cutting face has a non-planar geometry including a central region around a longitudinal axis of the cutting element, a plurality of grooves extending radially from a boundary of the central region to the cutting edge, wherein each groove has a base with a curved cross-sectional profile, and a plurality of lobes alternatingly formed between the plurality of grooves, wherein each lobe has a cross-sectional profile (Continued)

comprising an apex and opposite side surfaces sloping downwardly a distance from the apex to the base of adjacent grooves.

14 Claims, 23 Drawing Sheets

(56) References Cited

U.S. PATENT DOCUMENTS

| | | | | |
|---|---|---|---|---|
| 6,045,440 | A | 4/2000 | Johnson | |
| 6,065,554 | A | 5/2000 | Taylor | |
| 7,726,420 | B2 | 6/2010 | Shen et al. | |
| 7,757,785 | B2 | 7/2010 | Zhang et al. | |
| 7,798,257 | B2 | 9/2010 | Shen et al. | |
| 8,037,951 | B2 | 10/2011 | Shen et al. | |
| 8,113,303 | B2 | 2/2012 | Zhang et al. | |
| 8,413,746 | B2 | 4/2013 | Shen | |
| 8,739,904 | B2 | 6/2014 | Patel | |
| 8,807,247 | B2 * | 8/2014 | Scott | E21B 10/5735 175/379 |
| 9,033,070 | B2 | 5/2015 | Shen | |
| 9,097,074 | B2 | 8/2015 | Shen | |
| RE45,748 | E | 10/2015 | Zhang | |
| 9,797,200 | B2 * | 10/2017 | Scott | E21B 10/5673 |
| 10,287,825 | B2 | 5/2019 | Chen et al. | |
| 10,400,517 | B2 * | 9/2019 | Borge | E21B 10/46 |
| 10,428,585 | B2 * | 10/2019 | Scott | B24D 99/005 |
| 10,577,870 | B2 * | 3/2020 | Izbinski | E21B 10/5735 |
| 10,774,596 | B2 * | 9/2020 | Zhang | E21B 10/42 |
| 10,914,124 | B2 * | 2/2021 | Borge | C22C 26/00 |
| 11,215,012 | B2 | 1/2022 | Chen Chen | |
| 11,255,129 | B2 * | 2/2022 | Dubose | E21B 10/5676 |
| 11,873,684 | B2 * | 1/2024 | Zhao | E21B 10/5673 |
| 12,031,384 | B2 * | 7/2024 | Chen | E21B 10/5673 |
| 2011/0284293 | A1 * | 11/2011 | Shen | E21B 10/573 175/338 |
| 2012/0325563 | A1 * | 12/2012 | Scott | E21B 10/5676 175/428 |
| 2013/0068538 | A1 | 3/2013 | DiGiovanni | |
| 2013/0213720 | A1 * | 8/2013 | Bellin | E21B 10/567 175/428 |
| 2014/0353040 | A1 * | 12/2014 | Scott | E21B 10/567 175/57 |
| 2016/0032657 | A1 | 2/2016 | Zhang | |
| 2017/0292332 | A1 * | 10/2017 | Gledhill | E21B 10/573 |
| 2018/0044992 | A1 * | 2/2018 | Scott | E21B 10/00 |
| 2018/0283106 | A1 * | 10/2018 | Zhang | E21B 10/62 |
| 2018/0320450 | A1 * | 11/2018 | Borge | E21B 10/46 |
| 2019/0106943 | A1 | 4/2019 | Tilleman | |
| 2019/0203539 | A1 * | 7/2019 | Zhao | E21B 10/5673 |
| 2019/0309578 | A1 * | 10/2019 | Borge | E21B 10/5673 |
| 2019/0376346 | A1 * | 12/2019 | Vijayabalan | E21B 10/46 |
| 2020/0032588 | A1 * | 1/2020 | Izbinski | E21B 10/5673 |
| 2020/0032589 | A1 * | 1/2020 | Izbinski | E21B 10/5735 |
| 2020/0224500 | A1 * | 7/2020 | Dubose | E21B 10/5673 |
| 2021/0164296 | A1 * | 6/2021 | Zhao | E21B 10/5676 |
| 2022/0112773 | A1 * | 4/2022 | Chen | E21B 10/5735 |
| 2023/0417109 | A1 * | 12/2023 | Zhang | E21B 10/5673 |

OTHER PUBLICATIONS

International Preliminary Report on Patentability issued in International Patent application PCT/US2021/060593 dated Jun. 8, 2023, 7 pages.

* cited by examiner

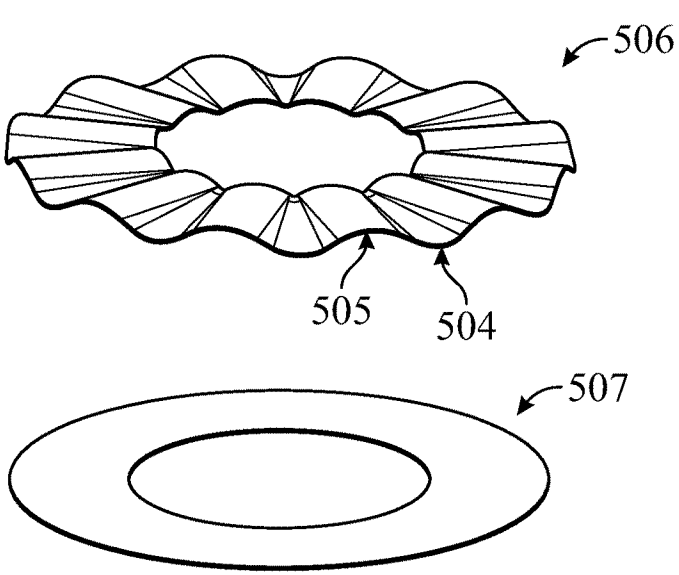
FIG. 11
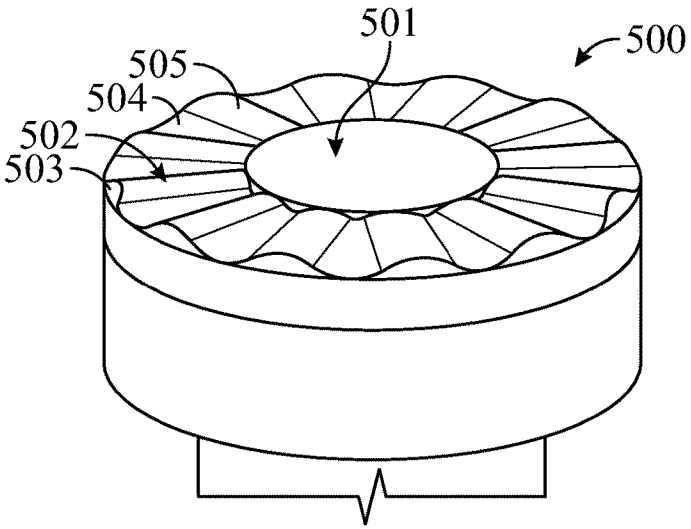
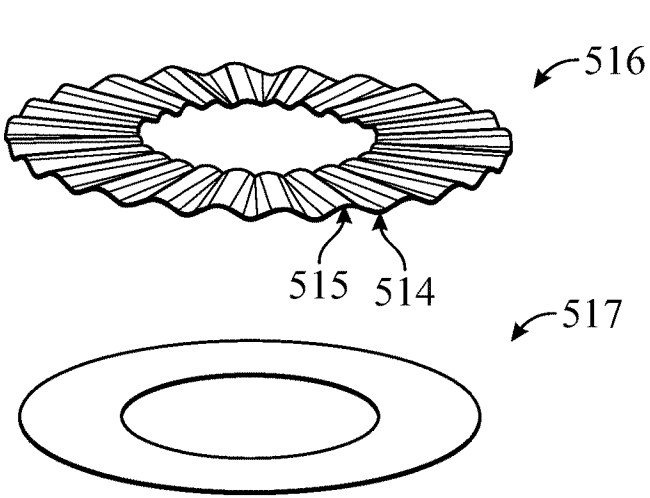
FIG. 12
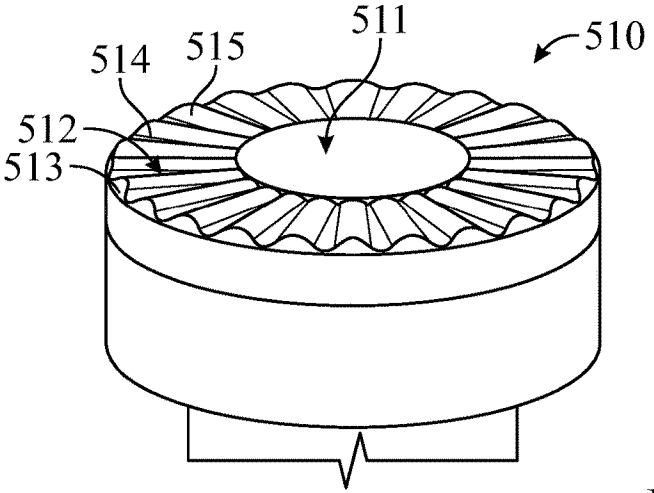

PDC CUTTER WITH ENHANCED PERFORMANCE AND DURABILITY

This application is the U.S. national phase of International Patent Application No PCT/US2021/060593, filed Nov. 23, 2021, and entitled "PDC Cutter with Enhanced Performance and Durability" which claims the benefit of, and priority to, U.S. Patent Application No. 63/117,694 filed on Nov. 24, 2020, both of which are incorporated herein by this reference in their entirety.

BACKGROUND

Drill bits used to drill wellbores through earth formations generally are made within one of two broad categories of bit structures. Drill bits in the first category are generally known as "roller cone" bits, which include a bit body having one or more roller cones rotatably mounted to the bit body and a plurality of cutting elements disposed at selected positions about the cones. Drill bits of the second category are typically referred to as "fixed cutter" or "drag" bits. This category of bits has no moving elements but rather have a bit body formed from steel or another high strength material and cutters (sometimes referred to as cutter elements, cutting elements or inserts) attached at selected positions to the bit body.

An example of a prior art drag bit having a plurality of cutters with ultra hard working surfaces is shown in FIG. 1. A drill bit 10 includes a bit body 12 and a plurality of blades 14 that are formed on the bit body 12. The blades 14 are separated by channels or gaps 16 that enable drilling fluid to flow between and both clean and cool the blades 14 and cutters 18. Nozzles 23 may be formed in the drill bit body 12 and positioned in the gaps 16 so that fluid can be pumped to discharge the drilling fluid.

The drill bit 10 includes a shank 24 having a threaded pin 28 for attachment to a drill string and a crown 26. The crown 26 has a cutting face 30 and outer side surface 32. A plurality of holes or pockets 34 that are sized and shaped to receive a corresponding plurality of cutters 18 may be formed in the crown 26 of the bit. Cutters 18 are held in the blades 14 at predetermined angular orientations and radial locations to present working surfaces 20 (also referred to as cutting faces) with a desired backrake angle against a formation to be drilled. Typically, the working surfaces 20 are generally perpendicular to the axis 19 and side surface 21 of a cylindrical cutter 18. Thus, the working surface 20 and the side surface 21 meet or intersect to form a circumferential cutting edge 22. The combined plurality of surfaces 20 of the cutters 18 effectively forms the cutting face 30 of the drill bit 10. Once the crown 26 is formed, the cutters 18 are positioned in the pockets 34 and affixed by any suitable method, such as brazing, adhesive, mechanical means such as interference fit, or the like.

Typical cutters 18 used in drag bits may have an ultrahard material layer (cutting layer) deposited onto or otherwise bonded to a substrate at an interface surface. The substrate may have a generally cylindrical shape and may be made of carbide, for example tungsten carbide. The ultrahard material layer forms the working surface 20 and the cutting edge 22 of the cutter 18. The ultrahard material layer may be a layer of polycrystalline diamond (PCD) or a polycrystalline cubic boron nitride (PCBN) layer.

SUMMARY

Embodiments herein may provide technical advantages from the disclosed geometries of a cutting element working surface for improving cutting element efficiency and extending the life of the cutting element.

In one aspect, embodiments of the present disclosure relate to cutting elements that include a longitudinal axis extending axially through the cutting element, a cutting face at an axial end of the cutting element, a peripheral surface extending circumferentially around the cutting face, and a cutting edge formed between the cutting face and the peripheral surface. The cutting face may have a non-planar geometry including a central region around a longitudinal axis of the cutting element, a plurality of grooves extending radially from a boundary of the central region to the cutting edge, wherein each groove has a base with a curved cross-sectional profile, and a plurality of lobes alternatingly formed between the plurality of grooves, wherein each lobe has a cross-sectional profile comprising an apex and opposite side surfaces sloping downwardly a distance from the apex to the base of adjacent grooves.

In another aspect, embodiments of the present disclosure relate to cutting elements having a support element and an inner rotatable cutting element rotatable within the support element, wherein the inner rotatable cutting element is rotatable about a longitudinal axis extending axially through the inner rotatable cutting element. The inner rotatable cutting element may include a cutting face at an axial end of the cutting element, a peripheral surface extending circumferentially around the cutting face, and a cutting edge formed between the cutting face and the peripheral surface. The cutting face may have a non-planar geometry including a central region encompassing an area around a longitudinal axis of the cutting element and a grooved region extending circumferentially around the central region and radially from a boundary of the central region to the cutting edge. The grooved region may include a plurality of grooves extending a radial distance from the boundary of the central region to the cutting edge, a plurality of lobes alternatingly formed between the grooves, each lobe having a cross-sectional profile comprising an apex and two opposite side surfaces extending between the apex and adjacent grooves on opposite sides of the lobe, and a grooved surface area ratio of at least 6:5, wherein the grooved surface area ratio is the ratio of a surface area of the grooved region to a planar area defined between the boundary of the central region to the cutting edge.

In yet another aspect, embodiments of the present disclosure relate to drill bits that include a bit body having a central axis extending axially through the bit body, a plurality of blades extending outwardly from the bit body, and a plurality of grooved cutting elements mounted on the blades. Each grooved cutting element may include a cutting face at an axial end of the cutting element, a peripheral surface extending circumferentially around the cutting face, and a cutting edge formed between the cutting face and the peripheral surface, wherein the cutting face has a non-planar geometry that includes a central region around a longitudinal axis of the cutting element, at least 24 grooves extending radially from a boundary of the central region to the cutting edge, and at least 24 lobes alternatingly formed between the grooves, each lobe having a cross-sectional profile comprising an apex and two opposite side surfaces extending between the apex and adjacent grooves on opposite sides of the lobe.

Other aspects and advantages of this disclosure will be apparent from the following description made with reference to the accompanying drawings and the appended claims.

BRIEF DESCRIPTION OF DRAWINGS

FIGS. 11-13 shows grooved region geometries and the grooved surface area ratio according to embodiments of the present disclosure.

DETAILED DESCRIPTION

Embodiments of the present disclosure relate generally to non-planar cutting face geometry of a polycrystalline diamond (PCD) cutting element. Non-planar cutting faces disclosed herein may include multiple radial ridges that extend radially from a central region of the cutting face to the perimeter of the cutting face to form an undulating cutting edge. The grooves formed between the radial ridges may act as channels for fluids to flow through during use of the cutting element, which may cool the cutting element, while the ridges may apply higher stress to the formation being cut when compared with cutting stresses from conventional cutting face geometry. Additionally, grooved cutting face geometries disclosed herein may allow greater leach depths, which may provide increased strength to the cutting face.

Figure 1:
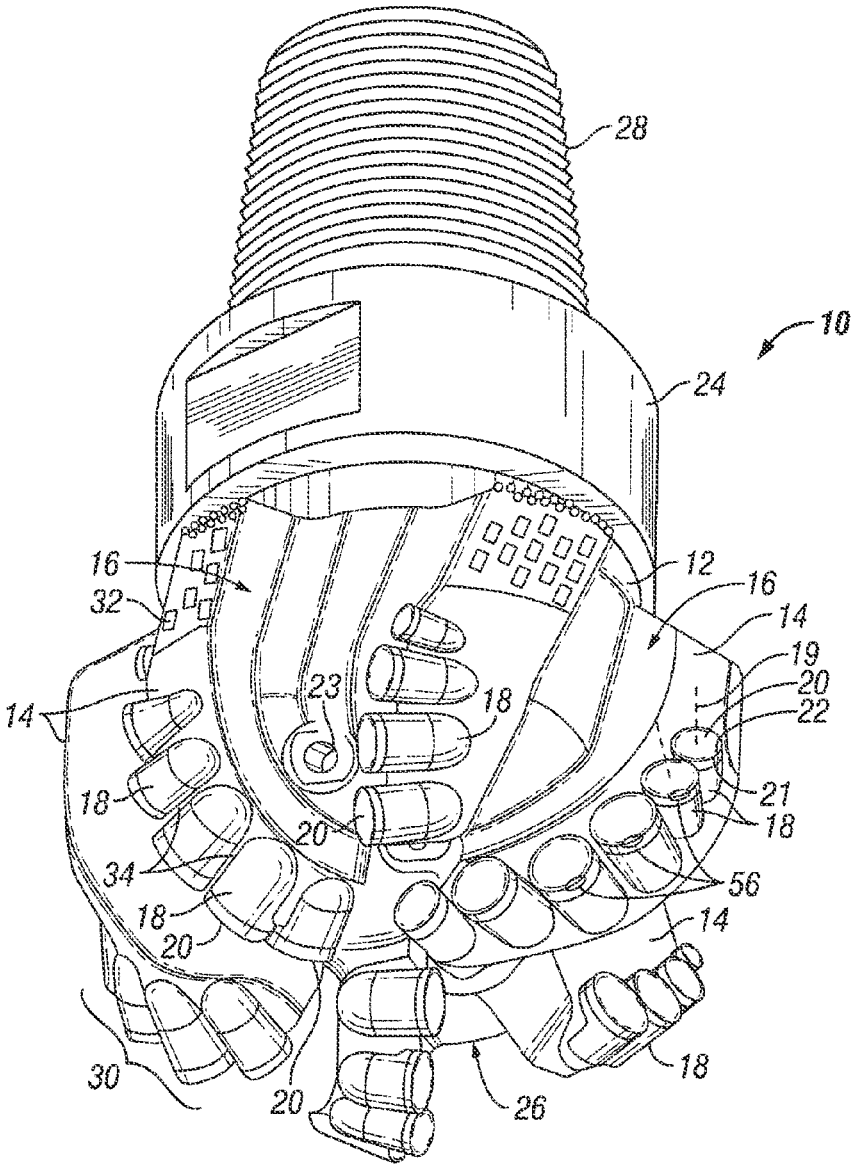
FIG. 1 (Prior Art)
FIG. 1 shows a perspective view of a conventional drill bit.
Figure 2:
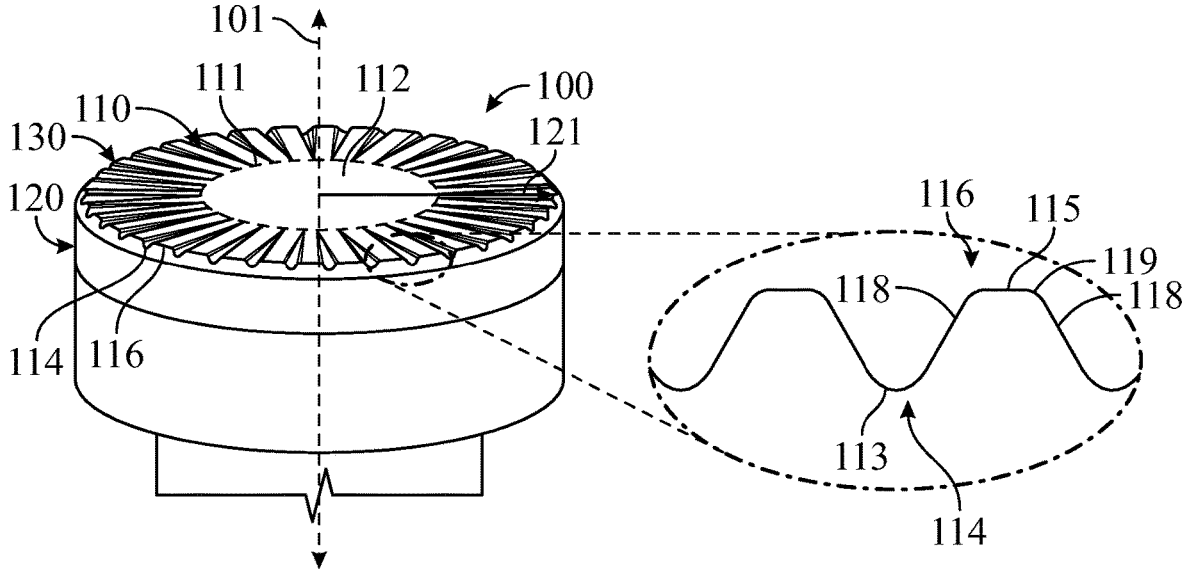
FIG. 2 shows a non-planar cutting face geometry according to embodiments of the present disclosure.

FIG. 2 shows an example of a cutting element 100 according to embodiments of the present disclosure. The cutting element 100 may have a generally cylindrical body with a longitudinal axis 101 extending axially through the cutting element 100. A non-planar cutting face 110 may be formed on an upper surface at an axial end of the cutting element 100, and a base surface may be formed at an opposite axial end of the cutting element 100. A peripheral surface 120 may extend circumferentially around the cutting face 110 and axially between the base surface and the cutting face 110. A cutting edge 130 may be formed at the intersection of the cutting face 110 and the peripheral surface 120.

The cutting face 110 geometry may include a central region 112 that encompasses an area around the longitudinal axis 101. The central region 112 may extend a substantially uniform radial distance around the longitudinal axis 101 to a boundary 111 of the central region 112 (e.g., a circular boundary). According to some embodiments, the boundary 111 of the central region 112 may extend a radial distance that is between 10 and 70 percent of a radius 121 of the cutting face 110. The central region 112 may have a substantially uniform surface geometry within the boundary 111. For example, as shown in the embodiment of FIG. 2, the central region 112 may have a planar surface extending along a plane perpendicular to the longitudinal axis 101, where the planar surface may form the entire central region 112.

The cutting face 110 geometry may further include a plurality of grooves 114 extending radially from the boundary 111 of the central region 112 to the cutting edge 130 and a plurality of lobes 116 alternatingly formed between the grooves 114. The alternating grooves 114 and lobes 116 may extend from the central region 112 around the entire boundary 111 of the central region 112 to around the entire perimeter of the cutting face 110. In such case, the entire cutting edge 130 may have an undulating profile formed of the alternating grooves 114 and lobes 116 positioned circumferentially around the cutting face.

The cross-sectional profiles of the lobes 116 and grooves 114 (as taken along an axial plane perpendicular to the radial direction) are shown in more detail in the exploded view. Each groove 114 may have a base 113 with a curved cross-sectional profile (e.g., with a uniform or varying radius of curvature). The lobes 116 may have an apex 115 and two opposite side surfaces 118 extending downwardly from opposite sides of the apex 115 to the base 113 of opposite and adjacent grooves 114. Curved transition surfaces 119 may extend between the apex 115 of each lobe 116 and the side surfaces 118. Additionally, smooth transitions may be formed between the grooves 114 and the lobes 116, such that the cross-sectional profile of the alternating grooves 114 and lobes 116 may have no sharp angles.

As shown in the embodiment in FIG. 2, the apex 115 of a lobe 116 may have a planar cross-sectional profile, where the apex planar surface may transition to the side surfaces 118 via curved transition surfaces 119. In other embodiments, an apex may be a curved, convex surface.

Figure 3:
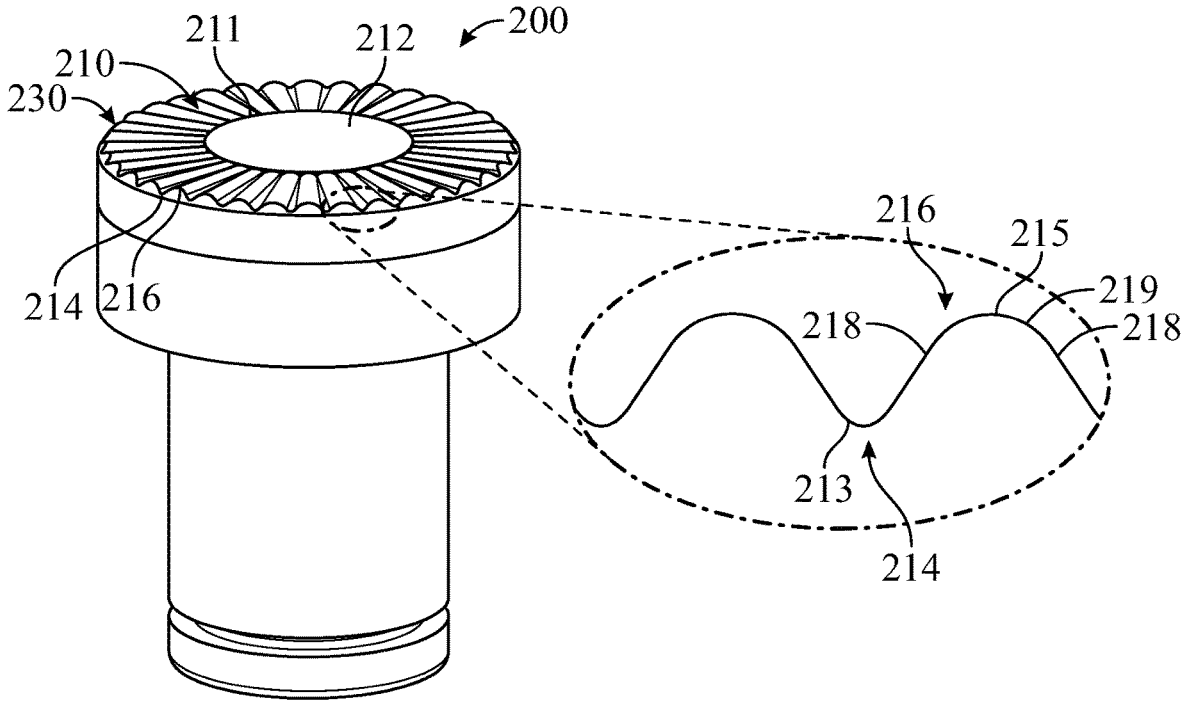
FIG. 3 shows a cutting element according to embodiments of the present disclosure.

For example, FIG. 3 shows another example of a cutting element 200 having a non-planar cutting face 210 according to embodiments of the present disclosure formed at an axial end of the cutting element 200. The cutting face 210 geometry may include a central region 212 defined within a boundary 211 and a plurality of alternating grooves 214 and lobes 216 extending radially from the boundary 211 of the central region 212 to a cutting edge 230. As shown in the exploded view of the groove 214 and lobe 216 cross-sectional profiles, the base 213 of each groove 214 and the apex 215 of each lobe 216 may have curved cross-sectional profiles. The base 213 may be a concave surface, and the apex 215 may be a convex surface. Curved transition surfaces 219 may provide a smooth transition between the apex 215 and the opposite side surfaces 218 of the lobe 216.

Figure 4:
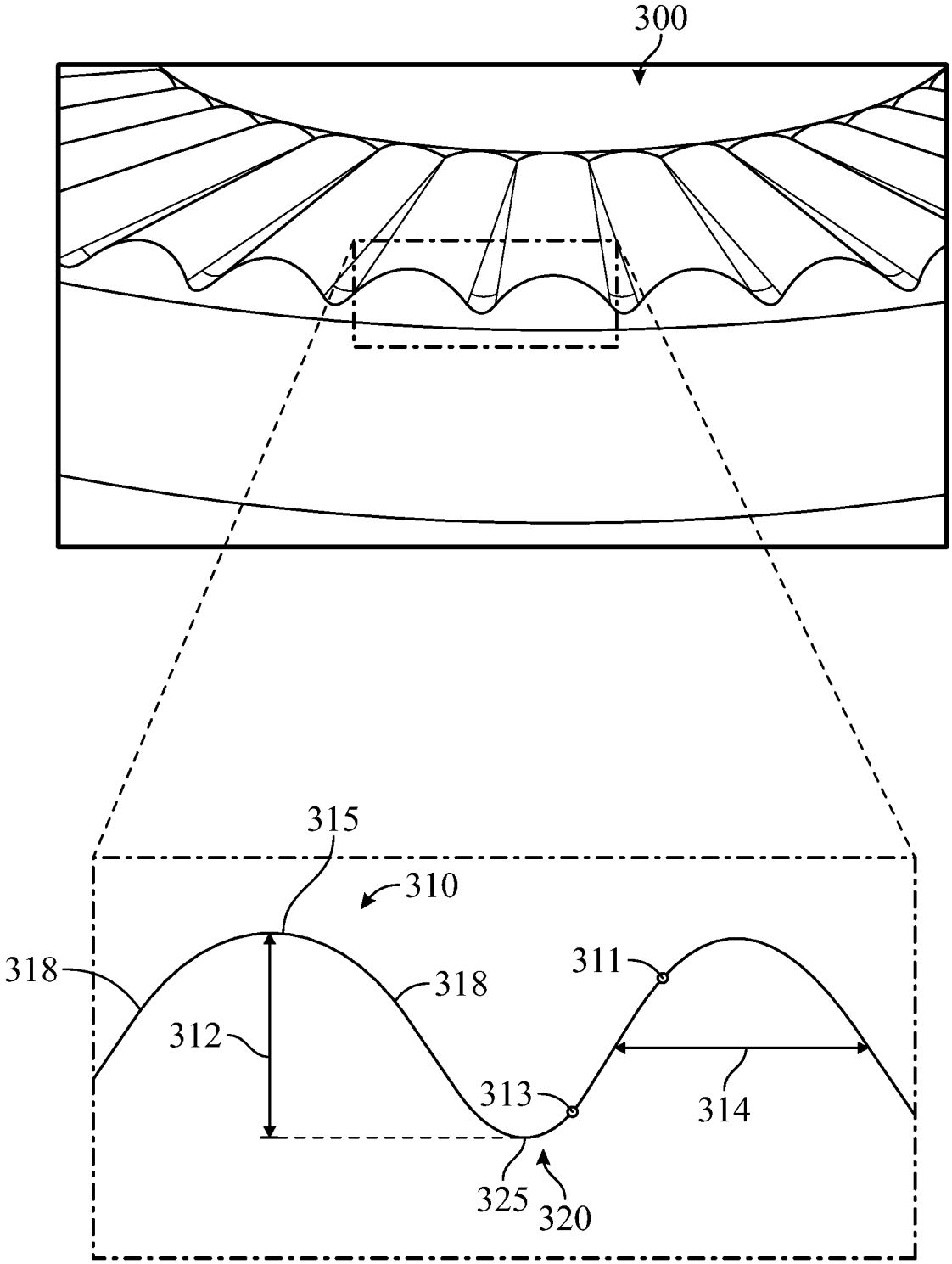
FIG. 4 shows a non-planar cutting face geometry according to embodiments of the present disclosure.

FIG. 4 shows another example of alternating lobe 310 and groove 320 geometry of non-planar cutting faces 300 according to embodiments of the present disclosure. As shown, lobes 310 may have a cross-sectional profile that includes side surfaces 318 extending in oppositely sloped directions from an apex 315. The side surfaces 318 may extend from a point 311 of transition from the apex 315 to a point 313 of transition to the base 325 of an adjacent groove 320. In some embodiments, points 311, 313 of transition may be marked as the point at which the radius of curvature of the base 325 and/or apex 315 changes. In some embodiments, points 311, 313 of transition may be marked as the point at which the slope of the side surface changes.

A height 312 of the lobe 310 may be measured along an axial dimension from the base 325 of an adjacent groove 320 to the apex 315 of the lobe 310. According to embodiments of the present disclosure, the height of each lobe 310 on a cutting face 300 may have the same height 312. Further, in some embodiments, the height 312 of a lobe 310 may be the same along the entire radial length of the lobe 310.

A width 314 of the lobe 310 may be measured along a dimension perpendicular to the height 312, and between the opposite side surfaces 318 of the lobe 310. In some embodiments, the width 314 of a lobe 310 may be measured at the midpoint of the height 312 of the lobe 310. In some embodiments, the width 314 of a lobe 310 may be measured between the points 313 of transition to the bases 325 of the adjacent grooves 320 on opposite sides of the lobe 310.

Figure 5:
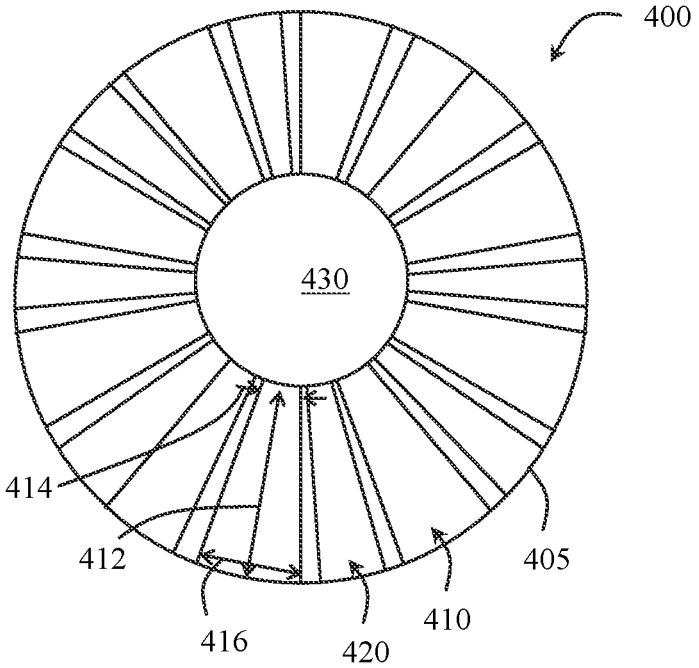
FIGS. 5-8 show grooved region geometries according to embodiments of the present disclosure.

Because the grooves and lobes extend in radial direction from a central region of the cutting face, the width of lobes and/or the grooves may vary along their radial length. For example, FIG. 5 shows a top view of a cutting face 400 having a non-planar geometry according to embodiments of the present disclosure. A plurality of alternating lobes 410 and grooves 420 extend a radial length 412 from a central region 430 of the cutting face 400 to a perimeter 405 of the cutting face 400. The width of the lobe 410 apexes (when measured between the points of transition from the lobe apex to the lobe side surfaces in a cross-sectional profile) and the width of the grooves 420 (when measured between the points of transition from the groove base to side surfaces of adjacent lobes in a cross-sectional profile) may get larger when moving along the radial direction from proximate the central region 430 to proximate the perimeter 405 of the cutting face 400. For example, as shown in FIG. 5, the width of a lobe 410 apex proximate the central region 430 may be a minimum width 414, and the width may get continuously larger along the radial length 412 of the lobe 410 to a maximum width 416 proximate the perimeter 405 of the cutting face 400.

Figure 6:
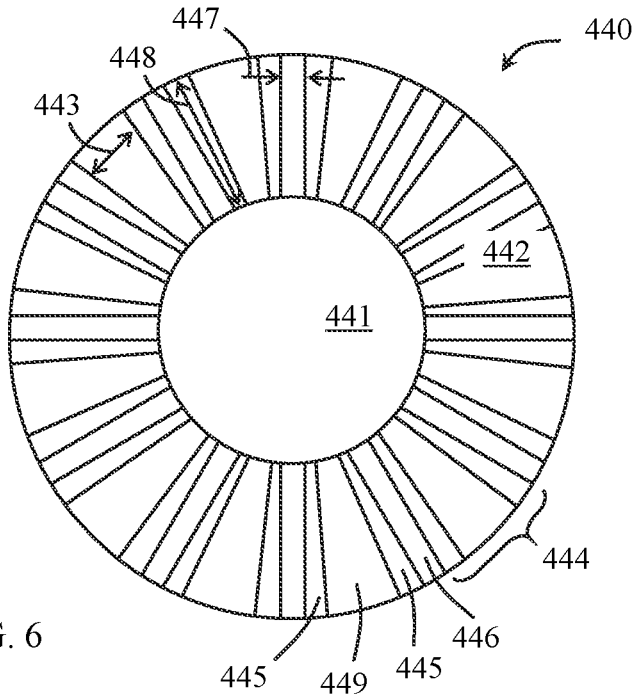

In some embodiments, the width of the grooves around a cutting face may be substantially constant along its radial length, while the width of the alternating lobes may increase along the radial length from a central region to the perimeter of the cutting face. For example, FIG. 6 shows a top view of a non-planar cutting face 440 according to embodiments of the present disclosure having a central region 441 and a grooved region 442 encompassing the central region 441. The grooved region 442 includes a plurality of lobes 444 extending radially from the central region 441 to the perimeter of the cutting face 440 and a plurality of grooves 446 alternatingly and circumferentially spaced between the lobes 444. The lobes 444 include oppositely sloping side surfaces 445 extending from an apex 449 of the lobe 444 to the base of the adjacent grooves 446. The grooves 446 may have a width 447 measured between the points of transition from the groove base to side surfaces 445 of adjacent lobes 444 that is substantially uniform along the entire radial length 448 of the groove 446. The lobes 444 may have an apex width 443 measured between the points of transition from the lobe apex 449 to the opposite side surfaces 445, where the apex width 443 may gradually increase from proximate the central region 441, along the radial length 448 of the lobe 444, to proximate the perimeter of the cutting face 440.

Figure 7:
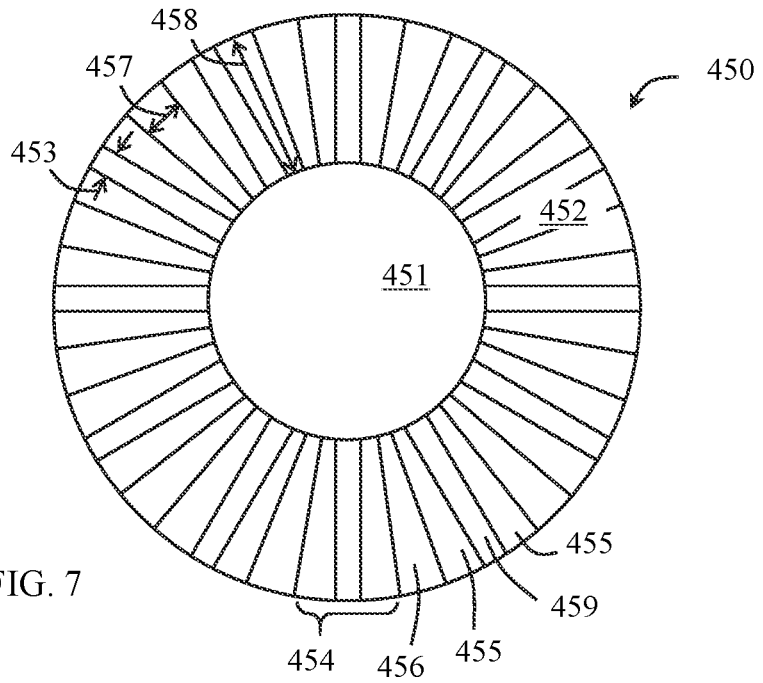

In some embodiments, an apex width of the lobes around a cutting face may be substantially constant along its radial length, while the width of the alternating grooves may increase along the radial length from a central region to the perimeter of the cutting face. For example, FIG. 7 shows a top view of a non-planar cutting face 450 according to embodiments of the present disclosure having a central region 451 and a grooved region 452 that encompasses the central region 451 and extends a radial length 458 from the central region 451 to the perimeter of the cutting face 450. The grooved region 452 includes a plurality of lobes 454 extending the radial length 458 from the central region 451 to the perimeter of the cutting face 450 and a plurality of grooves 456 alternatingly and circumferentially spaced between the lobes 454. The lobes 454 include oppositely sloping side surfaces 455 extending from an apex 459 of the lobe 454 to the base of the adjacent grooves 456. The grooves 456 may have a width 457 measured between the points of transition from the groove base to side surfaces 455 of adjacent lobes 454, where the width 457 may gradually increase from proximate the central region 451, along the radial length 458 of the groove 456, to proximate the perimeter of the cutting face 450. The lobes 454 may have an apex width 453 measured between the points of transition from the lobe apex 459 to the opposite side surfaces 455 that is substantially uniform along the entire radial length 458 of the lobe 454.

Figure 8:
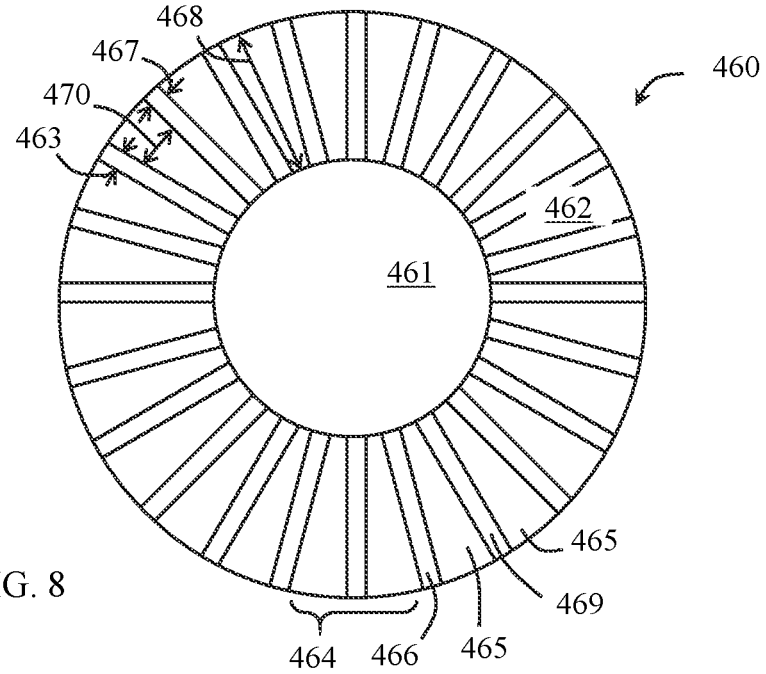

In some embodiments, both the apex width of the lobes and the width of the grooves around a cutting face may be substantially constant along their radial lengths. In such embodiments, the lobe side surfaces may extend different distances between the lobe apex and adjacent groove bases along the radial dimension. For example, FIG. 8 shows a top view of a non-planar cutting face 460 according to embodiments of the present disclosure having a central region 461 and a grooved region 462 encompassing the central region 461, where the grooved region 462 extends a radial length 468 from the central region 461 to the perimeter of the cutting face 460. The grooved region 462 includes a plurality of lobes 464 extending the radial length 468 from the central region 461 to the perimeter of the cutting face 460 and a plurality of grooves 466 alternatingly and circumferentially spaced between the lobes 464. The lobes 464 include oppositely sloping side surfaces 465 extending from an apex 469 of the lobe 464 to the base of the adjacent grooves 466.

The grooves 466 may have a width 467 measured between the points of transition from the groove base to side surfaces 465 of adjacent lobes 464 that is substantially uniform along the entire radial length 468 of the groove 466.

The lobes 464 may have an apex width 463 measured between the points of transition from the lobe apex 469 to the opposite side surfaces 465 that is also substantially uniform along the entire radial length 468 of the lobe 464. The side surfaces 465 may extend a distance 470 measured along a cross-sectional profile between a point of transition from the apex 469 to the side surface 465 and a point of transition from the side surface 465 to the base of an adjacent groove 466. The distance 470 of the side surfaces 465 may gradually increase along the radial length 468, from the central region 461 to the perimeter of the cutting face 460.

Figure 9:
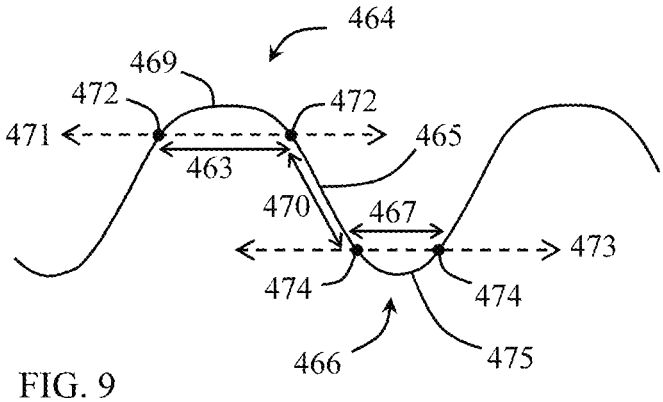
FIG. 9 shows a cross-sectional profile of a grooved region geometry according to embodiments of the present disclosure.

FIG. 9 shows a cross-sectional profile view of the grooved region 462 shown in FIG. 8. The alternating lobes 464 and grooves 466 may have an undulating geometry, where the cross-sectional profile of the lobes 464 may be generally convex and the cross-sectional profile of the grooves 466 may be concave, with smooth transitions between the adjacent lobes and grooves 466. The apex width 463 may be measured along a plane 471 perpendicular to the longitudinal axis of the cutting element and between points 472 of transition from the apex 469 to the opposite side surfaces 465, wherein the apex width 463 may be uniform along the radial length 468 if the lobe 464 from the boundary of the central region 461 to the cutting edge of the cutting element. The width 467 of the groove 466 may be measured along another plane 473 perpendicular to the longitudinal axis of the cutting element and between points 474 of transition from the base 475 of the groove 466 to the opposite side surfaces 465, wherein the base width 467 may be uniform along the entire radial length 468 of the groove 466. The distance of the side surfaces between the apexes 469 and the bases 475 of adjacent lobes and grooves may vary along the radial length 468 of the lobes 464.

According to embodiments of the present disclosure, the geometry of each lobe formed around a cutting face may be the same as the remaining lobes formed around the cutting face, e.g., having the same minimum width, having the same maximum width, having the same height, and having the same radial length, such as shown in FIGS. 5-8. Likewise, the geometry of each groove formed around a cutting face may be the same as the remaining grooves formed around the cutting face, such as shown in FIGS. 5-8.

The geometry of alternating grooves and lobes formed around non-planar cutting faces disclosed herein may provide an axisymmetric geometry about the longitudinal axis of the cutting element. For example, a cutting element according to embodiments of the present disclosure may have a cutting face that includes a central region encompassing an axisymmetric area around the longitudinal axis of the cutting element. The cutting face may further include a grooved region around the central region that is formed of plurality of lobes and grooves extending radially from the central region to the cutting edge (along radial planes lying along the longitudinal axis and intersecting the peripheral surface of the cutting element). The lobes and grooves may be evenly spaced circumferentially around the cutting face, where each lobe may have the same geometry and each groove may have the same geometry, such that the grooved region may have an axisymmetric geometry about the longitudinal axis of the cutting element.

Figure 10:
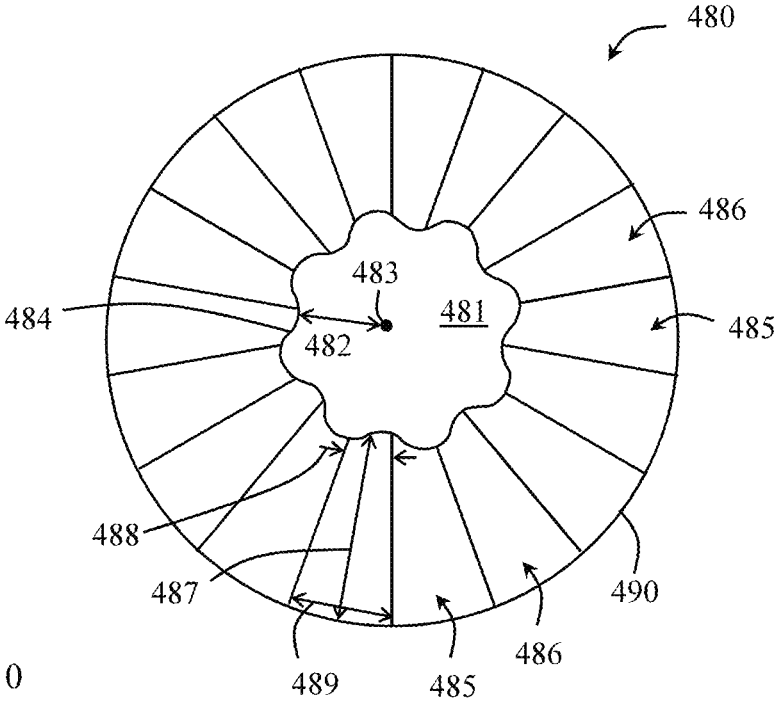
FIG. 10 shows a grooved region geometry according to embodiments of the present disclosure.

In some embodiments, different lobes and/or grooves around a cutting face may have different geometries. For example, as shown in FIG. 10, a cutting face 480 having a non-planar geometry according to embodiments of the present disclosure may have a central region 481 that extends a non-uniform radial distance 482 from the longitudinal axis 483 of the cutting element, where the boundary 484 of the central region 481 may have a non-circular shape (e.g., elliptical, multipoint star-shaped, etc.). At portions of the central region boundary 484 that are radially closer to the longitudinal axis 483, the radially extending lobes 485 and grooves 486 may have a relatively longer radial length 487 and smaller minimum width 488, while at portions of the central region boundary 484 that are radially farther from the longitudinal axis 483, the radially extending lobes 485 and grooves 486 may have a relatively shorter radial length 487 and larger minimum width 488. In embodiments having a non-circular central region 481, the alternating lobes 485 and/or grooves 486 may have substantially the same geometry at the perimeter 490 of the cutting face 480 as the other lobes 485 and grooves 486 around the cutting face 480. For example, each lobe 485 formed around the cutting face 480 may have the same maximum width 489.

In other embodiments having a non-circular central region 481, different lobes 485 and/or grooves 486 may have different geometries proximate the perimeter 490 of the cutting face than other lobes and/or grooves around the cutting face. In yet other embodiments having a non-circular central region 481, the central region may have an axisymmetric shape that may at least in part align with the circumferential spacing of the lobes and grooves. For example, in some embodiments, a cutting face may have a central region with an axisymmetric, non-circular shape and a plurality of alternating lobes and grooves extending radially from the central region, where all the lobes may have the same geometry and all the grooves may have the same geometry.

The height and width of lobes may vary, for example, depending on the number of alternating grooves and lobes positioned circumferentially around the cutting face and the diameter of the cutting face. According to embodiments of the present disclosure, a height to width ratio of the lobes when measured proximate the cutting edge may range from a lower limit selected from 1:20, 1:15, and 1:10 to an upper limit selected from 4:5, 1:1, and 2:1. In some embodiments, a height to width ratio of the lobes formed on the cutting face, when measured proximate the cutting edge of the cutting element, may range between 1:10 and 1:1. For example, referring again to FIG. 5, a lobe 410 may have a height and a maximum width 416 measured proximate the perimeter 405 of the cutting face 400 with a height to width ratio of between 2:5 to 4:5. Cutting faces having a relatively greater amount of lobes may have a relatively higher height to width ratio, and cutting faces having a relatively fewer amount of lobes may have a relatively lower height to width ratio.

The number and size of alternating lobes and grooves formed around non-planar cutting faces according to embodiments of the present disclosure may be designed to provide an increased surface area in the grooved region of the cutting face. For example, FIGS. 11-13 show examples of different cutting face geometries according to embodiments of the present disclosure having different amounts and sizes of lobes and grooves positioned circumferentially around the cutting face to provide different grooved region surface areas.

Figure 13:
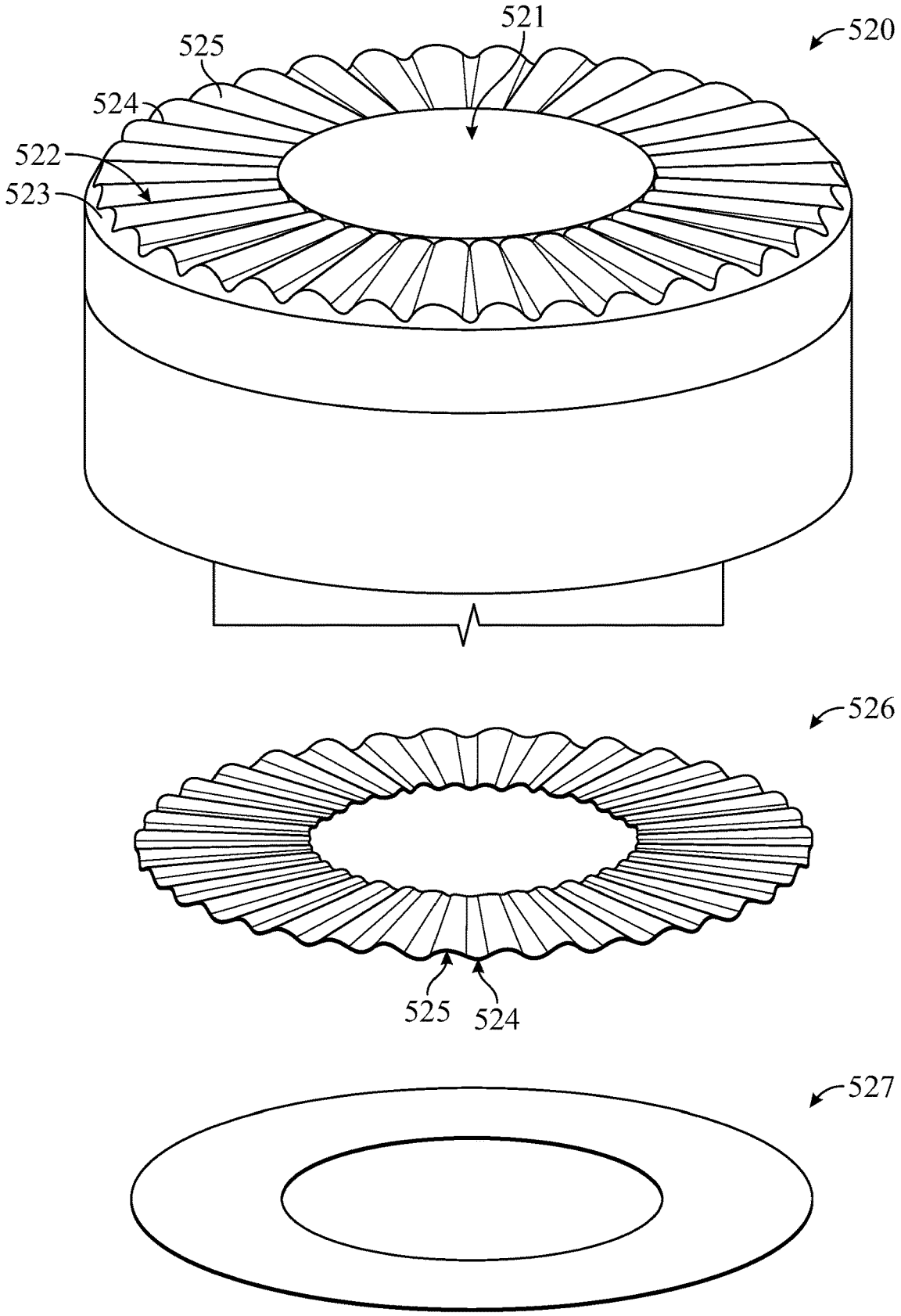

In FIGS. 11-13, the cutting faces 500, 510, 520 may include a central region 501, 511, 521 encompassing an area around a longitudinal axis of the cutting element and a grooved region 502, 512, 522 extending circumferentially around the central region 501, 511, 521 and radially from a boundary of the central region to the cutting edge 503, 513, 523 of the cutting element. The grooved regions may each include a plurality of grooves 504, 514, 524 extending a radial distance from the boundary of the central region 501, 511, 521 to the cutting edge 503, 513, 523 and a plurality of lobes 505, 515, 525 alternatingly formed between the grooves 504, 514, 524. Each lobe 505, 515, 525 may have a cross-sectional profile formed of an apex and two opposite side surfaces extending between the apex and adjacent grooves 504, 514, 524 on opposite sides of the lobe, such as described herein.

The shape and number of the lobes 505, 515, 525 and grooves 504, 514, 524 formed within the grooved region 502, 512, 522 may be designed to provide an increased grooved region surface area 506, 516, 526. The grooved region surface area 506, 516, 526 of the alternating lobes 505, 515, 525 and grooves 504, 514, 524 is shown adjacent to each corresponding cutting element.

The grooved region surface area 506, 516, 526 may be compared to a corresponding planar area 507, 517, 527 to determine a grooved surface area ratio. The planar area 507, 517, 527 may be calculated as the area of a plane extending perpendicularly to the longitudinal axis of the cutting element and defined between the boundary of the central region 501, 511, 521 and the cutting edge 503, 513, 523. Once the grooved region surface area 506, 516, 526 and the corresponding planar area 507, 517, 527 are determined, the grooved surface area ratio may be calculated as the ratio of the grooved region surface area 506, 516, 526 to a planar area 507, 517, 527. According to embodiments of the present disclosure, a cutting face may have a grooved surface area ratio of at least 6:5, at least 13:10, or greater than 7:5, for example. In some embodiments, a cutting face may have a grooved surface area ratio of up to 2:1 or up to 5:2. For example, grooved cutting face geometries may provide a grooved surface area ratio ranging between 6:5 and 2:1.

As shown in FIG. 11, the cutting face 500 may have 12 lobes 505 and 12 grooves 504 alternatingly positioned around the cutting face 500. The lobes 505 may be evenly spaced circumferentially around the cutting face 500, where each lobe 505 may have the same geometry and each groove 504 positioned between lobes 505 may have the same geometry. In the embodiment shown, each lobe 505 may have a substantially uniform width along its radial length, and each groove 504 may have an increasing width along its radial length from proximate the central region 501 to proximate the cutting edge 503. The grooved region 502 geometry may provide a grooved surface area ratio of about 5:4. For example, when the grooved region geometry is formed on a 16 mm cutting element, the grooved region surface area 506 may be about 0.25 $in^2$ and the planar area 507 may be about 0.2 $in^2$. According to embodiments of the present disclosure, the grooved region surface area 506 may be increased, for example, to between 0.26 $in^2$ and 0.35 $in^2$, by increasing the height of the lobes 505, and thus, may increase the grooved surface area ratio to between 13:10 and 7:4.

As shown in FIG. 12, the cutting face 510 may have 24 lobes 515 and 24 grooves 514 alternatingly positioned around the cutting face 510. The lobes 515 may be evenly spaced circumferentially around the cutting face 510, where each lobe 515 may have the same geometry and each groove 514 positioned between lobes 515 may have the same geometry. In the embodiment shown, each lobe 515 may have a substantially uniform apex width along its radial length, and each groove 514 may have an increasing width along its radial length. The grooved region 512 geometry may provide a grooved surface area ratio of about 121:100. For example, when the grooved region geometry is formed on a 16 mm cutting element, the grooved region surface area 516 may be about 0.24 $in^2$ and the planar area 517 may be about 0.2 $in^2$.

As shown in FIG. 13, the cutting face 520 may have 36 lobes 525 and 36 grooves 524 alternatingly positioned around the cutting face 520. The lobes 525 may be evenly spaced circumferentially around the cutting face 520, where each lobe 525 may have the same geometry and each groove 524 positioned between lobes 525 may have the same geometry. In the embodiment shown, each lobe 525 may have an increasing width along its radial length, and each groove 524 may have an increasing width along its radial length. The grooved region 522 geometry may provide a grooved surface area ratio of about 31:25. For example, when the grooved region geometry is formed on a 16 mm cutting element, the grooved region surface area 526 may be about 0.245 $in^2$ and the planar area 527 may be about 0.2 $in^2$. According to embodiments of the present disclosure, the grooved region surface area 526 may be increased, for example, to between 0.25 $in^2$ and 0.3 $in^2$, by increasing the height of the lobes 525, and thus, may increase the grooved surface area ratio to between 5:4 and 3:2.

According to embodiments of the present disclosure, the height of a lobe (as measured in an axial dimension between the apex of the lobe and the base of an adjacent groove) may vary along the radial length of the lobe. For example, the apex of a lobe may slope downwardly and outwardly from a central region of the cutting face, where the height of the lobe may decrease along its radial length from the central region to the cutting edge. As another example, the apex of a lobe may slope upwardly and outwardly from a central region of the cutting face. where the height of the lobe may increase along its radial length from the central region to the cutting edge.

Figure 15:
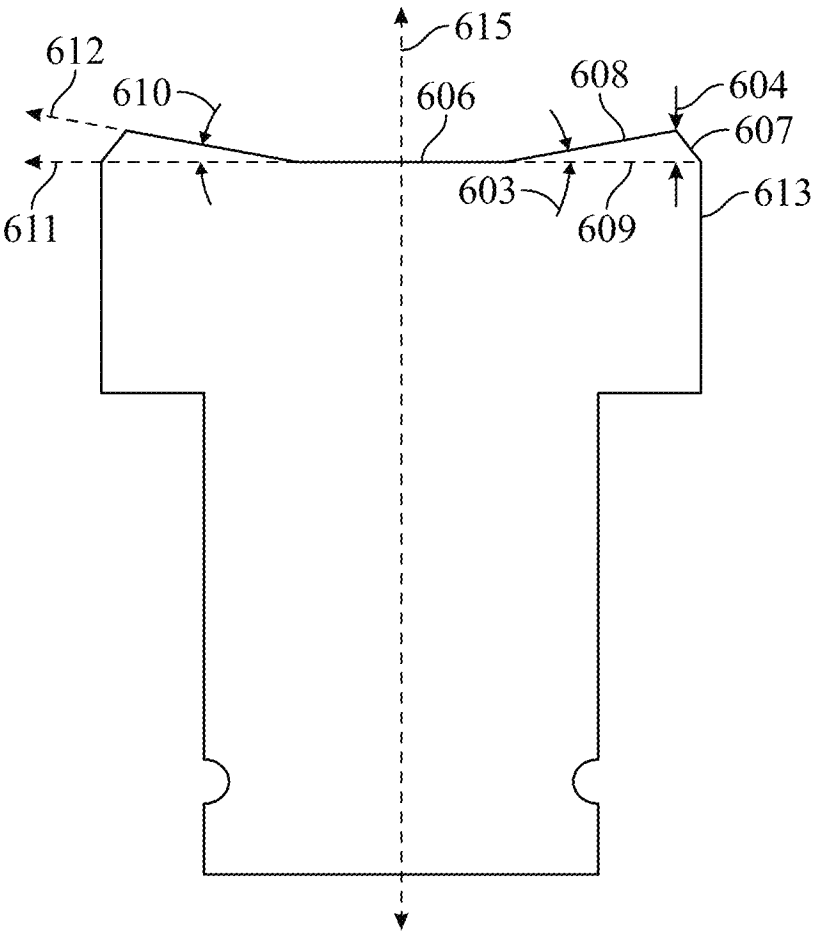
FIG. 15 shows a cross-sectional view along an axial plane of the cutting element shown in FIG. 14.
Figure 14:
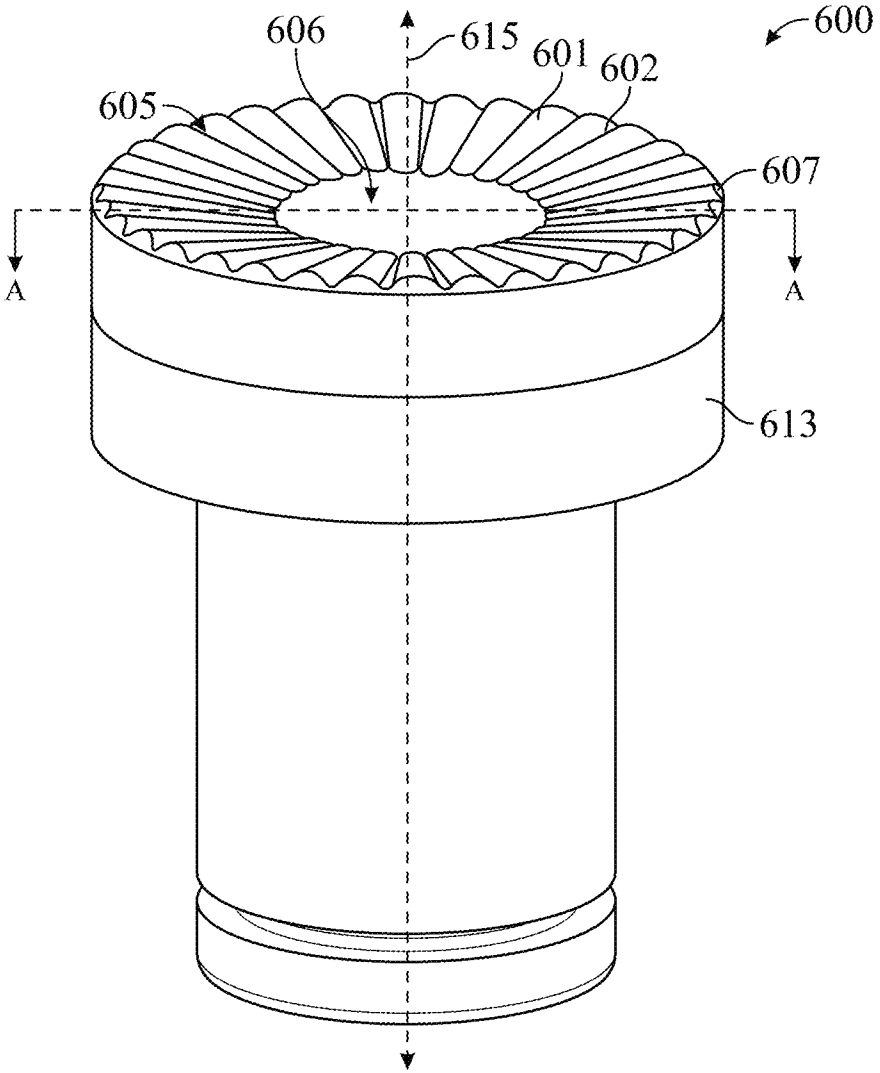
FIG. 14 shows a cutting element according to embodiments of the present disclosure.

FIGS. 14 and 15 show an example of a cutting element 600 according to embodiments of the present disclosure having lobes 601 with a varying height 603, 604. FIG. 14 is a perspective view of the cutting element 600, and FIG. 15 is a cross-sectional view of the cutting element 600 along the axial A-A plane. The cutting element 600 may have a non-planar cutting face formed on an axial end of the cutting element 600 that includes a grooved region 605 surrounding a central region 606. The grooved region 605 may include a plurality of alternating grooves 602 and lobes 601 that extend radially from the central region 606 to a cutting edge 607 of the cutting element. A lobe height 603, 604 may be measured in an axial dimension between the apex 608 of the lobe 601 and the base 609 of an adjacent groove 602. The apex 608 of each lobe 601 may extend a radial length from the boundary of the central region 606 at a projection angle 610, where projection angle 610 is measured between a horizontal plane 611 extending perpendicular to the longitudinal axis 615 and a line 612 tangent to and extending the radial length of the apex 608.

In the embodiment shown, the horizontal plane 611 is coplanar with the base 609 of the grooves 602 and is co-planar with the surface of the central region 606. However, in some embodiments, grooves in a non-planar cutting face may have a base that is not co-planar with a horizontal plane perpendicular to the longitudinal axis. For example, groove bases may extend along the radial length of the groove at a positive angle from a horizontal plane (e.g., in an upward sloping direction from the central region) or groove bases may extend along the radial length of the groove at a negative angle form a horizontal plane (e.g., in a downward sloping direction from the central region). In some embodiments, the bases 609 of the grooves 602 may be coplanar with the central region 606. In such embodiments, the apexes 608 of the lobes 601 may be axially higher than the central region 606. Further, in some embodiments, the central region may have a non-planar surface, such as a concave surface, a convex surface, or a combination of planar and non-planar surfaces, for example.

According to embodiments of the present disclosure, lobes 601 may have a projection angle 610 greater than 0 degrees, e.g., up to 10 degrees or up to 20 degrees, such that the lobe height may gradually increase from proximate the central region 606 to the cutting edge 607. In embodiments having upwardly sloping lobes 601, the non-planar cutting face may have a generally concave shape. For example, as shown in FIG. 15, a lobe 601 may have a minimum lobe height 603 at a radial location proximate the central region 606 and a continuously increasing lobe height along the radial length of the lobe 601 to a maximum lobe height 604 at a radial location proximate the cutting edge 607 of the cutting element. In the embodiment shown, the cutting edge 607 is formed of a chamfer or bevel, where the chamfer surface slopes downwardly and outwardly from the lobe 601 to the peripheral surface 613. The chamfer 607 may intersect (at a sharp or curved intersection) the apex 608 of the lobe 601 at the lobe's maximum lobe height 604.

Figure 17:
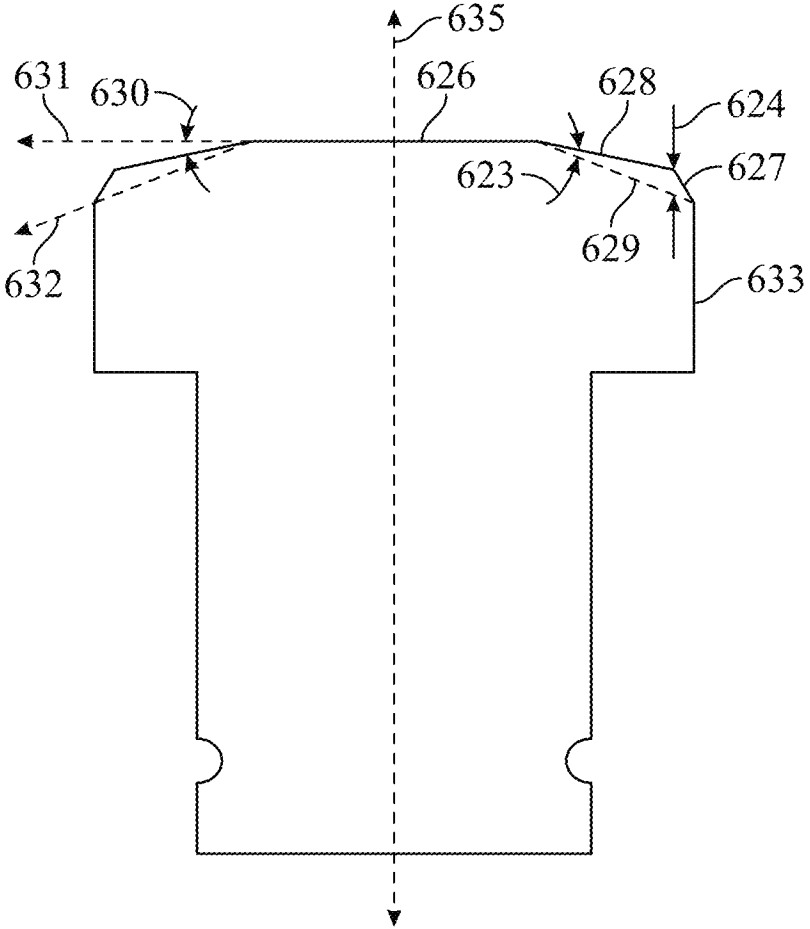
FIG. 17 shows a cross-sectional view along an axial plane of the cutting element shown in FIG. 16.
Figure 16:
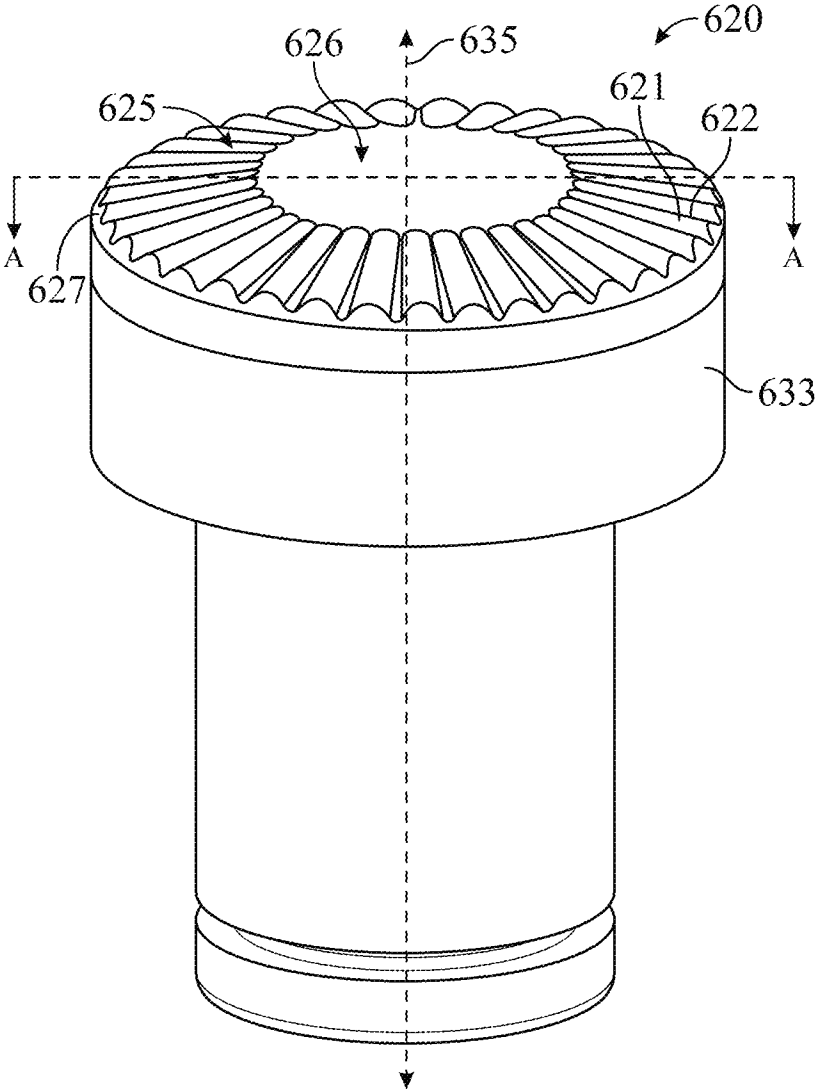
FIG. 16 shows a cutting element according to embodiments of the present disclosure.

FIGS. 16 and 17 show another example of a cutting element 620 according to embodiments of the present disclosure having lobes 621 that slope at a projection angle 630 from the central region 626 of the cutting element 620. FIG. 16 is a perspective view of the cutting element 620, and FIG. 17 is a cross-sectional view of the cutting element 620 along the axial A-A plane. The cutting element 620 may have a non-planar cutting face formed on an axial end of the cutting element 620 that includes a grooved region 625 surrounding a central region 626. The grooved region 625 may include a plurality of alternating grooves 622 and lobes 621 that extend radially from the central region 626 to a cutting edge 627 of the cutting element. A lobe height 623, 624 may be measured in an axial dimension between the apex 628 of the lobe 621 and the base 629 of an adjacent groove 622.

The apex 628 of each lobe 621 may extend a radial length from the boundary of the central region 626 at a projection angle 630, where projection angle 630 is measured between a horizontal plane 631 extending perpendicular to the longitudinal axis 635 and a line 632 tangent to and extending the radial length of the apex 628. According to embodiments of the present disclosure, lobes 621 may have a projection angle 630 less than 0 degrees, e.g., ranging from 0 to −20 degrees or to −40 degrees, such that the lobes 621 slope downwardly and outwardly from the central region 626. In embodiments having downwardly sloping lobes 621, the non-planar cutting face may have a generally convex shape.

The grooves 622 may have bases 629 that also slope downwardly and radially outward from the central region 626 at an angle less than the lobe 621 projection angle 630, such that the lobe height may gradually increase from proximate the central region 626 to the cutting edge 627. For example, as shown in FIG. 17, a lobe 621 may have a minimum lobe height 623 at a radial location proximate the central region 626 and a continuously increasing lobe height along the radial length of the lobe 621 to a maximum lobe height 624 at a radial location proximate the cutting edge 627 of the cutting element. In the embodiment shown, the cutting edge 627 is formed of a chamfer or bevel, where the chamfer surface slopes downwardly and outwardly from the lobe 621 to the peripheral surface 633 at a steeper slope than the projection angle 630 of the lobe 621. The chamfer 627 may intersect (at a sharp or curved intersection) the apex 628 of the lobe 621 at the lobe's maximum lobe height 624.

According to embodiments of the present disclosure, the apex of each lobe on a cutting face may extend a radial length (e.g., measured along a radial plane that extends axially through the longitudinal axis and the peripheral surface of the cutting element) from the central region to the cutting edge at a 0 degree projection angle. For example, in some embodiments, a cutting face may include a planar central region and a plurality of lobes extending radially from the central region to the cutting edge at a 0° projection angle. In such embodiments, the central region may be coplanar with the apexes of the lobes, such as shown in the embodiments in FIGS. 2 and 3.

Grooved region geometry according to embodiments of the present disclosure may include lobes that are symmetrically shaped about a radial plane bisecting the radial length of the lobe, or may include lobes having an asymmetric geometry about a radial plane bisecting the radial length of the lobe. For example, FIGS. 18-20 show examples of different lobe geometry having different symmetries about a radial plane bisecting the radial length of the lobe.

Figure 18:
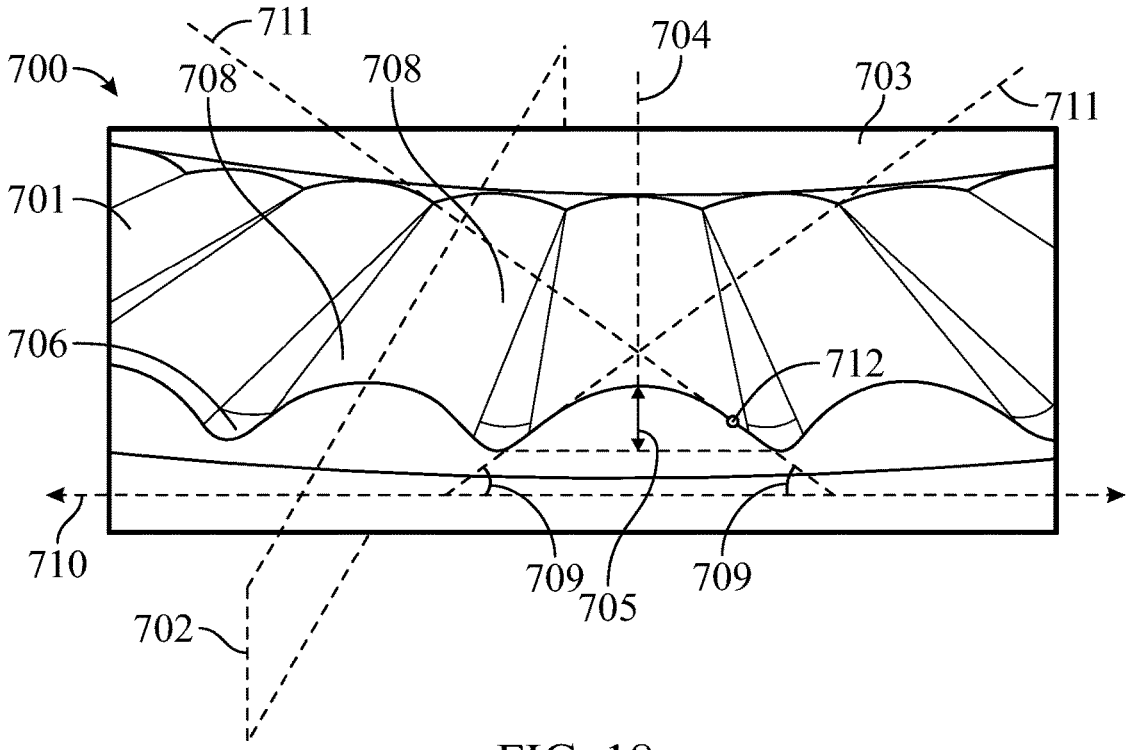
FIGS. 18-20 show grooved region geometries according to embodiments of the present disclosure.

In FIG. 18, a cutting face may have a grooved region 700 with a plurality of lobes 701 extending radially along a radial plane 702 from a central region 703 of the cutting face to a perimeter of the cutting face. The lobes 701 may have a geometry that is symmetric about the radial plane 702. The lobes 701 each have an apex 704 that extends the radial length of the lobe 701. The lobe height 705 may be measured in an axial dimension between the lobe apex 704 and the base of an adjacent groove 706. In the embodiment shown, the lobes 701 have a rounded top surface, where in a cross-sectional profile of the lobe 701, the highest point of the lobe top surface forms the apex 704. In other embodiments, lobes may have a flat top surface, where entire flat top surface may form the apex of the lobe.

Two opposite side surfaces 708 may extend between the top surface of the lobe 701 and the adjacent grooves 706. Each side surface 708 may slope at an inclination angle 709 between the top surface of the lobe 701 and the adjacent groove 706, where the inclination angle may be measured between a horizontal plane 710 perpendicular to the longitudinal axis of the cutting element and a line 711 tangent to the side surface 708 of the lobe 701 at a midpoint 712 of the lobe height 705. The inclination angle 709 of each of the opposite side surfaces 708 may be equal.

Figure 19:
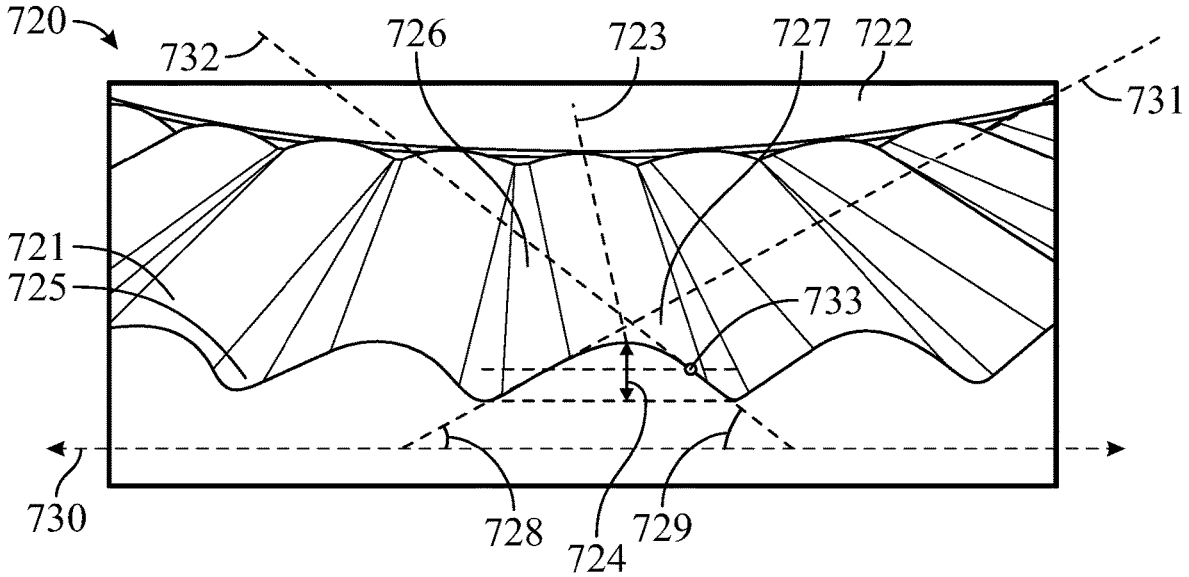
Figure 20:
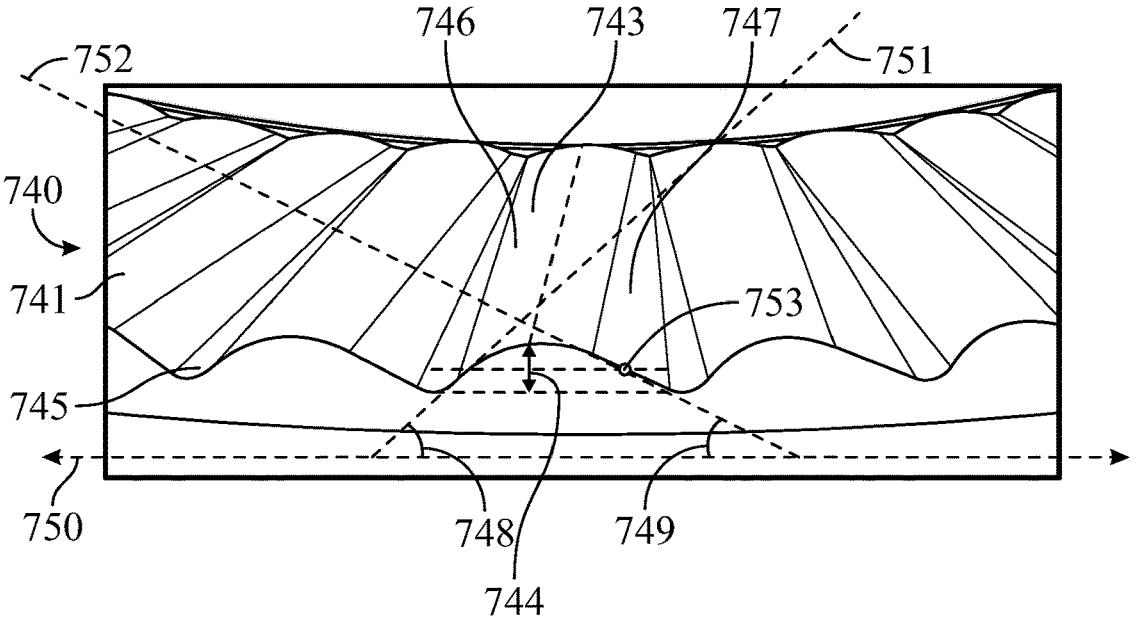

In some embodiments, such as shown in FIGS. 19 and 20, the lobes formed in a grooved region may have asymmetric geometries about a radial plane, where the inclination angles of each of the opposite side surfaces may have a different inclination angle.

In FIG. 19, the grooved region 720 includes a plurality of lobes 721 extending radially from a central region 722 of the cutting face to a perimeter of the cutting face. The lobes 721 each have an apex 723 that extends the radial length of the lobe 721. In the embodiment shown, the lobes 721 have a rounded top surface, where in a cross-sectional profile of the lobe 721, the highest point of the lobe top surface forms the apex 723. The lobe height 724 may be measured in an axial dimension between the lobe apex 723 and the base of an adjacent groove 725.

Opposite side surfaces 726, 727 of the lobes 721 may extend at different inclination angles 728, 729 between the apex 723 of the lobe 721 and the adjacent grooves 725, such that the lobes 721 may have a geometry that is asymmetric about a radial plane bisecting the apex 723 of the lobes 721. Each lobe 721 may have a first side surface 726 sloping at a first inclination angle 728, where the first inclination angle 728 is measured between a horizontal plane 730 perpendicular to the longitudinal axis of the cutting element and a line 731 tangent to a first side surface 726 at a midpoint 733 of the lobe height 724. Each lobe 721 may further include a second side surface 727 sloping in an opposite direction from the first side surface 726 at a second inclination angle 729, where the second inclination angle is measured between the horizontal plane 730 and a line 732 tangent to the second side surface 727 at a midpoint 733 of the lobe height 724. In some embodiments, the slope of the tangent lines 731, 732 may be taken at a midpoint of the side surfaces. The first inclination angle 728 may be less than the second inclination angle 729. Further, the first side surface 726 may extend a greater distance between the top surface of the lobe 721 and the adjacent groove 725 than the second side surface 727, such that the lobe 721 slopes in the counterclockwise direction.

FIG. 20 shows an example of a cutting face with a grooved region 740 having a plurality of spaced apart lobes 741 that are sloped in a clockwise direction. The lobes 741 each have an apex 743 that extends the radial length of the lobe 741. The lobe height 744 may be measured in an axial dimension between the lobe apex 743 and the base of an adjacent groove 725.

Opposite side surfaces 746, 747 of the lobes 741 may extend at different inclination angles 748, 749 between the top surface of the lobe 741 and the adjacent grooves 745, such that the lobes 741 may have a geometry that is asymmetric about a radial plane bisecting the apex 743 of the lobes 741. Each lobe 741 may have a first side surface 746 sloping at a first inclination angle 748, where the first inclination angle 748 is measured between a horizontal plane 750 perpendicular to the longitudinal axis of the cutting element and a line 751 tangent to a first side surface 746 at a midpoint 753 of the lobe height 744. Each lobe 741 may further include a second side surface 747 sloping in an opposite direction from the first side surface 746 at a second inclination angle 749, where the second inclination angle is measured between the horizontal plane 750 and a line 752 tangent to the second side surface 747 at a midpoint 753 of the lobe height 744. The first inclination angle 748 may be greater than the second inclination angle 749. Further, the first side surface 746 may extend a smaller distance between the top surface of the lobe 741 and the adjacent groove 745 than the second side surface 747, such that the lobe 741 slopes in the clockwise direction.

Figure 21:
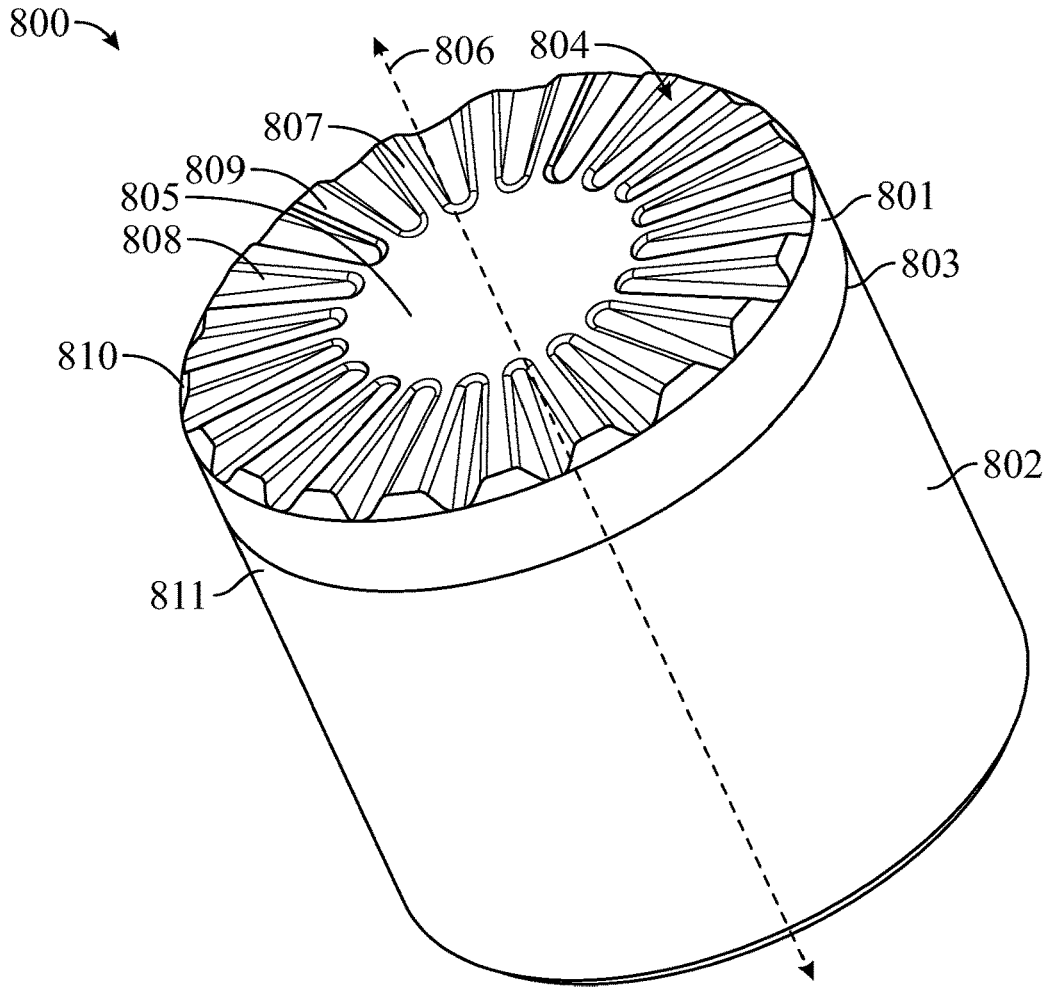
FIG. 21 shows a perspective view of a cutting element according to embodiments of the present disclosure.

Grooved geometry disclosed herein may be formed on an upper surface of a polycrystalline diamond (PCD) or other ultrahard material cutting element. For example, as shown in FIG. 21, a cutting element 800 according to embodiments of the present disclosure may include a PCD layer 801 mounted to a substrate 802 at an interface 803. The cutting element 800 may have a generally cylindrical shape with cutting face 804 formed on an upper surface of the PCD layer 801, opposite the interface 803. The cutting face 804 may have grooved geometry according to embodiments of the present disclosure, including a central region 805 surrounding a longitudinal axis 806 of the cutting element and a grooved region 807 surrounding the central region 805. The central region 805 may be a flat surface that extends a uniform radius from the longitudinal axis 806 (forming a circular shape), and the grooved region 807 may extend circumferentially around the entire boundary of the central region 805. The grooved region 807 may include a plurality of alternating grooves 808 and lobes 809 that extend radially from the central region 805 to the cutting edge 810 of the cutting element 800. The cutting edge 810 may be formed around the entire perimeter of the cutting face 804, where the cutting face 804 meets the peripheral surface 811 of the cutting element 800. In the embodiment shown, a chamfer may be formed around the cutting edge 810.

The PCD layer 801 may be formed by sintering diamond particles together using a transition metal catalyst, such as cobalt, resulting in a microstructure having a plurality of bonded together diamond grains and a plurality of interstitial regions formed between the bonded together diamond grains. After forming the PCD, the catalyst material used to form the PCD may be collected within the interstitial regions of the PCD microstructure and referred to as a binder. The substrate 802 may be formed of a carbide material, such as tungsten carbide or other transition metal carbide. In some embodiments, catalyst material for forming the PCD layer may be provided from the substrate material by forming the PCD layer in a sintering process with the substrate 802.

According to embodiments of the present disclosure, a PCD cutting face 804 may be leached to remove (or render non-reactive) binder material trapped within the PCD microstructure. The strength and life of a cutting face formed of PCD may be improved by removing the binder material in the PCD material through one or more leaching processes. Leaching processes may include, for example, submerging the PCD material in one or more acid. However, when leaching a PCD cutting element 800 with a substrate 802, the leaching process may be limited to the PCD layer 801 to avoid degrading the substrate 802. For example, in some embodiments, a substrate may be masked to prevent leaching acid from contacting the substrate (which would degrade the substrate). In some embodiments, a PCD cutting element 800 may be partially contacted with leaching fluids to prevent contact of the fluids with an attached substrate, for example, by submerging only the cutting face 804 in a shallow amount of leaching fluids.

Figure 22:
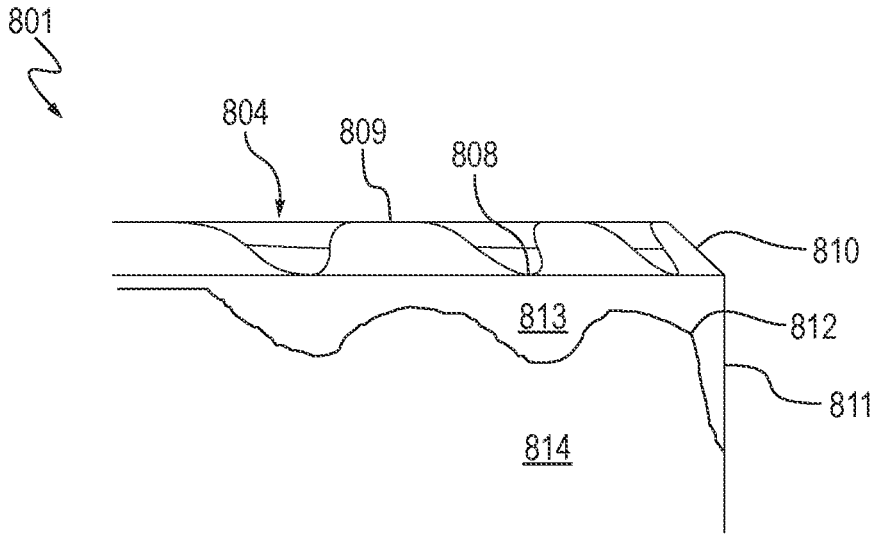
FIGS. 22 and 23 are cross-sectional partial views of PCD layers showing a comparison of leaching a grooved cutting face according to embodiments of the present disclosure and a planar cutting face.
Figure 23:
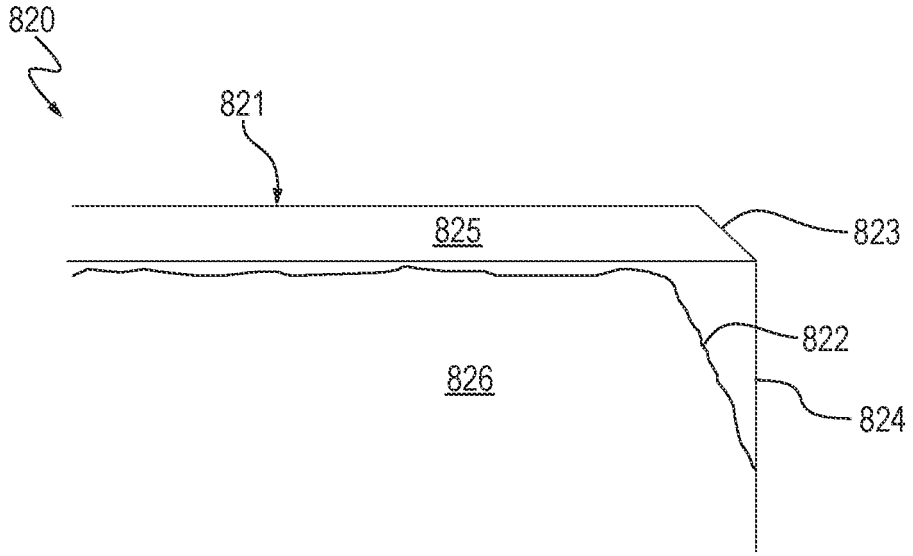

When grooved cutting face geometry according to embodiments of the present disclosure is used on PCD cutting elements, a greater leach volume may be obtained when compared with using the same leach process on a non-grooved cutting face. For example, FIGS. 22 and 23 show a comparison of leach depth using the same leaching process to leach a planar cutting face and a non-planar grooved cutting face according to embodiments of the present disclosure. FIG. 22 shows a partial cross-sectional view of the PCD layer 801 shown in FIG. 21 having a non-planar cutting face 804 with a plurality of alternating grooves 808 and lobes 809. The cutting face 804 has been dipped in a leaching fluid to remove the binder material from the PCD microstructure. When contacted with the leaching fluid for a period of time, the leaching fluid may remove the binder up to a leaching depth, as indicated by the leaching line 812. As shown, the leaching line 812 may substantially correspond with the PCD layer geometry that was contacted with the leaching fluid, where the leaching depth may extend from the cutting face 804, the cutting edge 810, and a portion of the peripheral surface 811 that was contacted with the leaching fluid. The leaching line 812 may extend deeper into the PCD layer 801 around the grooves 808 than around the lobes 809, thereby having a generally undulating leaching line 812 corresponding with the grooved region geometry of the cutting face 804. The leached portion 813 of the PCD layer 801 may have a microstructure that includes a plurality of bonded together diamond grains and is substantially free of a catalyst within the interstitial regions. The unleached portion 814 of the PCD layer 801 may have a microstructure that includes a metal binder disposed in interstitial regions formed between bonded together diamond grains.

In FIG. 23, a partial cross-sectional view of a PCD layer 820 having a planar cutting face 821 is shown. The cutting face 821 has been dipped in the same leaching fluid for the same period of time as used in the leaching process from FIG. 22 to remove the binder material from the PCD microstructure up to a leaching depth, as indicated by the leaching line 822. As shown, the leaching line 822 may substantially correspond with the PCD layer geometry that was contacted with the leaching fluid, where the leaching depth may extend from the cutting face 821, the cutting edge 823, and a portion of the peripheral surface 824 that was contacted with the leaching fluid. The leached portion 825 of the PCD layer 820 may have a microstructure that includes a plurality of bonded together diamond grains and is substantially free of a catalyst within the interstitial regions. The unleached portion 826 of the PCD layer 820 may have a microstructure that includes a metal binder disposed in interstitial regions formed between bonded together diamond grains.

As shown by FIGS. 22 and 23, using non-planar cutting face geometries disclosed herein may allow for a greater leach depth when compared with planar cutting face geometries using the same leaching process. A greater relative leach depth may provide increased strength to the cutting face and a longer cutting life.

According to embodiments of the present disclosure, grooved cutting face geometry disclosed herein may be provided on a rotatable cutting element. The grooved region geometry may be designed to enhance rotatability of rotatable cutting elements when mounted to a cutting tool, such as a drill bit, as the rotatable cutting element contacts a working surface.

Figure 25:
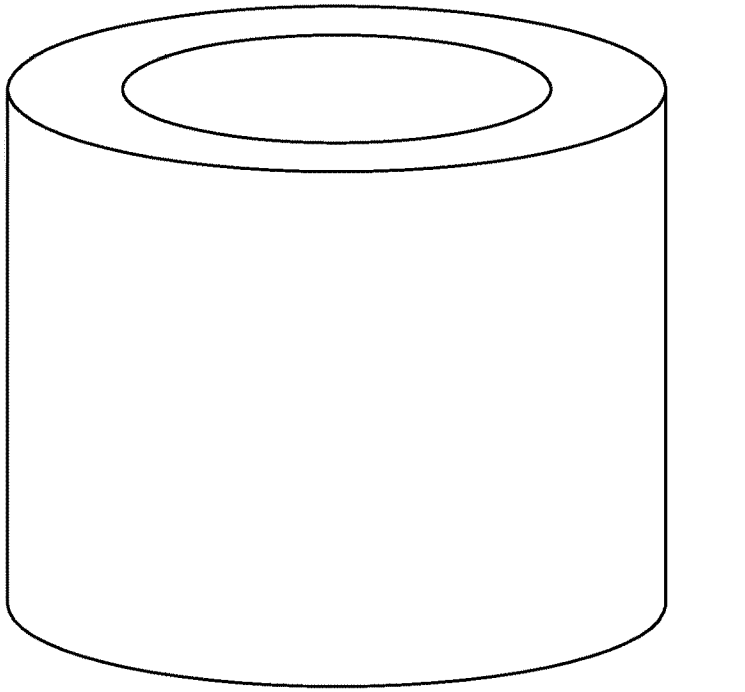
FIG. 25 shows an outer support element according to embodiments of the present disclosure.
Figure 24:
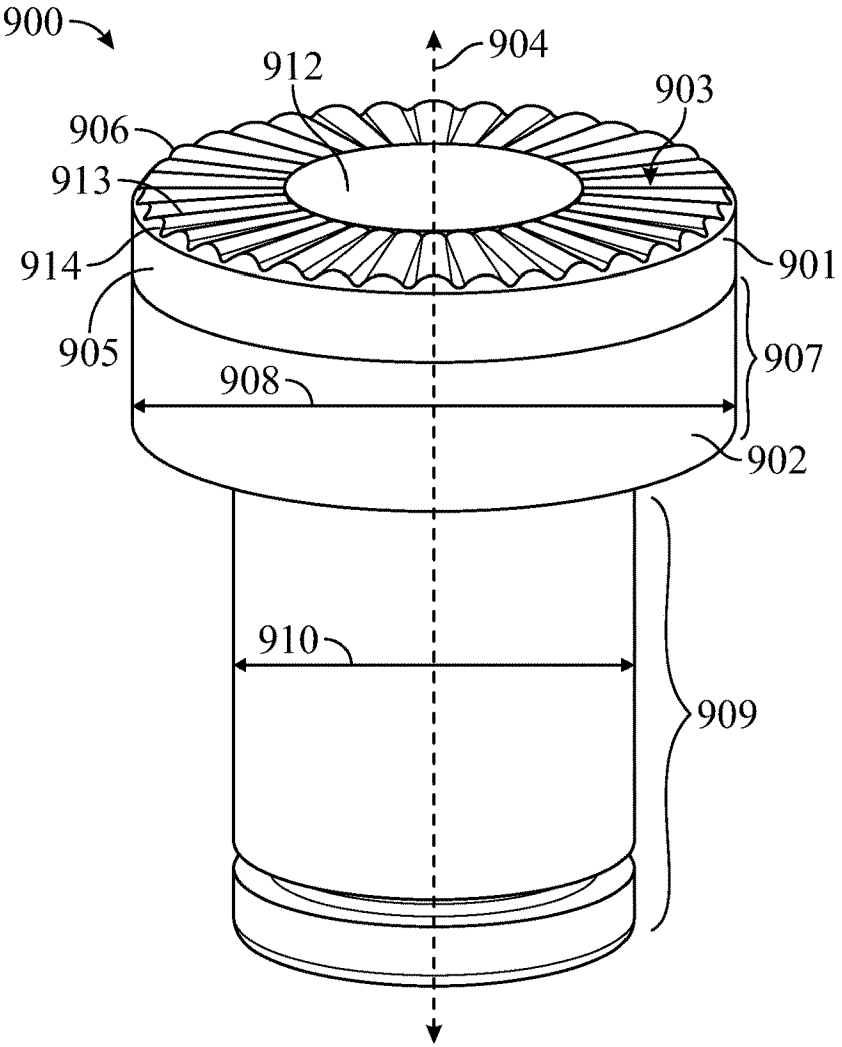
FIG. 24 shows a perspective view of a rotatable cutting element according to embodiments of the present disclosure.
Figure 26:
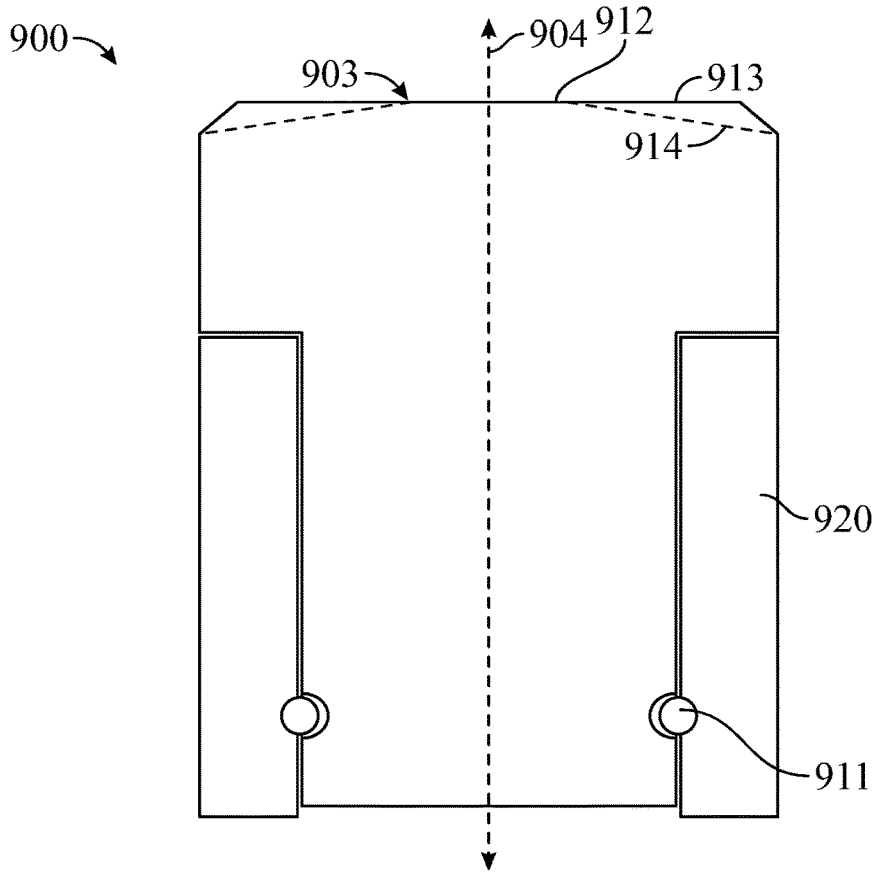
FIG. 26 shows a cross-sectional view of the rotatable cutting element shown in FIG. 24 assembled to the outer support element shown in FIG. 25.

For example, FIGS. 24-26 show an example of grooved cutting face geometry according to embodiments of the present disclosure provided on a rotatable cutting element 900. Rotatable cutting elements 900, such as shown in FIGS. 24 and 26, may be rotatably mounted to an outer support element 920, such as shown in FIG. 25, or may be rotatably mounted directly to a cutting tool, e.g., a drill bit.

As shown in FIG. 24, a rotatable cutting element 900 may include a PCD layer 901 mounted to a substrate 902, where a non-planar cutting face 903 according to embodiments of the present disclosure is formed on an upper surface of the PCD layer 901. The rotatable cutting element 900 may have an axisymmetric geometry about a longitudinal axis 904 extending axially through the cutting element 900. For example, in the embodiment shown, the PCD layer 901 may have a generally cylindrical peripheral surface 905, an axisymmetric grooved cutting face 903, and a cutting edge 906 formed between the peripheral surface 905 and the cutting face 903. The substrate 902 may have a backing portion 907 attached to the PCD layer 901 that also has a cylindrical peripheral surface defining a diameter 908 of the backing portion 907. A generally cylindrical spindle portion 909 may extend co-axially from the backing portion 907 and has a diameter 910 less than the diameter 908 of the backing portion 907.

The spindle portion 909 may be journaled to an outer support element 920 such that the rotatable cutting element 900 may rotate within the outer support element 920. As shown in FIG. 25, an outer support element 920 may have a tubular shape in which at least a portion of the substrate 902 may be inserted into. As shown in FIG. 26, at least one retention element 911 (e.g., balls or protrusions) may be used to axially retain the rotatable cutting element 900 within the outer support element 920 while also allowing the rotatable cutting element 900 to rotate within the outer support element.

Other axisymmetric geometries of a cutting element substrate may be provided to allow rotation of the cutting element within an outer support element. For example, in some embodiments, one or more protrusions may be formed around the outer surface of a substrate, which may protrude outwardly into a corresponding groove formed in an outer support element, thereby axially retaining the rotatable cutting element to the outer support element while also allowing the rotatable cutting element to rotate relative to the outer support element. Further, other configurations of an outer support element may be provided to at least partially surround an inner rotatable cutting element (e.g., extending at least a portion around the circumference of the rotatable cutting element) to allow rotation of the rotatable cutting element relative to the outer support element. For example, an outer support element may extend around less than the entire circumference of a rotatable cutting element and optionally include a top surface and/or bottom surface, where the axially positioned top and/or bottom surfaces may axially retain the rotatable cutting element within the outer support element while also allowing the rotatable cutting element to rotate within the outer support element.

The non-planar cutting face 903 may have a central region 912 encompassing an area of the cutting face 903 around the longitudinal axis 904 of the cutting element 900. A plurality of grooves 914 may be formed in the cutting face 903, extending radially between the cutting edge 906 and the boundary of the central region 912. A plurality of lobes 913 are alternatingly formed between the plurality of grooves 914. The lobes 913 may have an apex that is coplanar with the central region 912, while the grooves 914 may slope downwardly and outwardly from the central region 912 to the cutting edge 906.

The grooved cutting face geometry may enhance rotatability of the rotatable cutting element. For example, a grooved cutting face geometry having a relatively deeper grooves (e.g., a higher maximum lobe height) may be a factor in increasing rotatability. As another example, providing an increased amount of alternating lobes and grooves in a grooved cutting face geometry may increase rotatability of the cutting element (e.g., more than 20 lobes, more than 24 lobes, more than 30 lobes, or more than 36 lobes, depending on the size of the cutting element). Additionally, the shape of the lobe surfaces in grooved cutting face geometries may affect rotatability. For example, flat top surfaces on lobes may provide increased friction with a working surface, thereby increasing rotatability.

Figure 27:
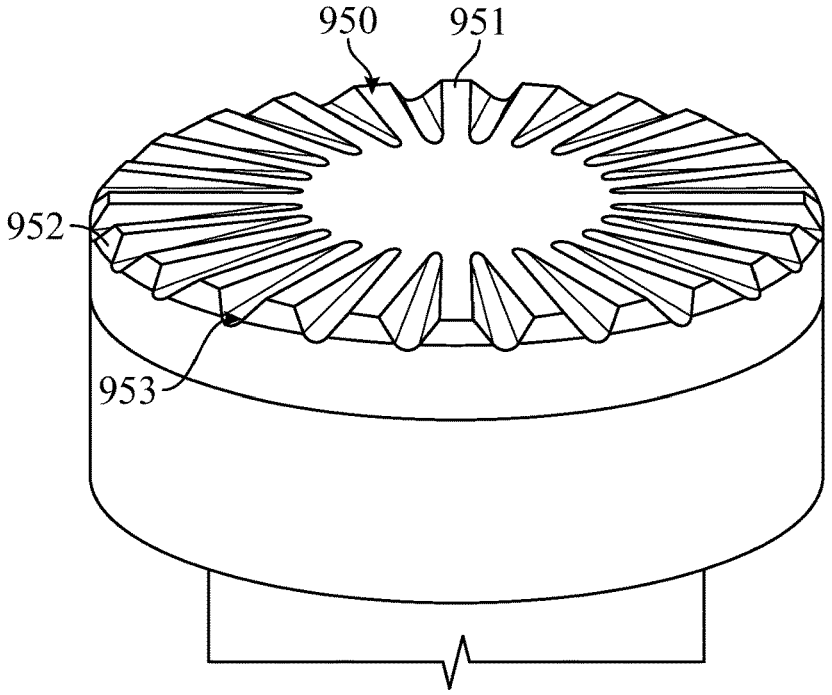
FIGS. 27-29 show grooved cutting face geometries according to embodiments of the present disclosure.
Figure 28:
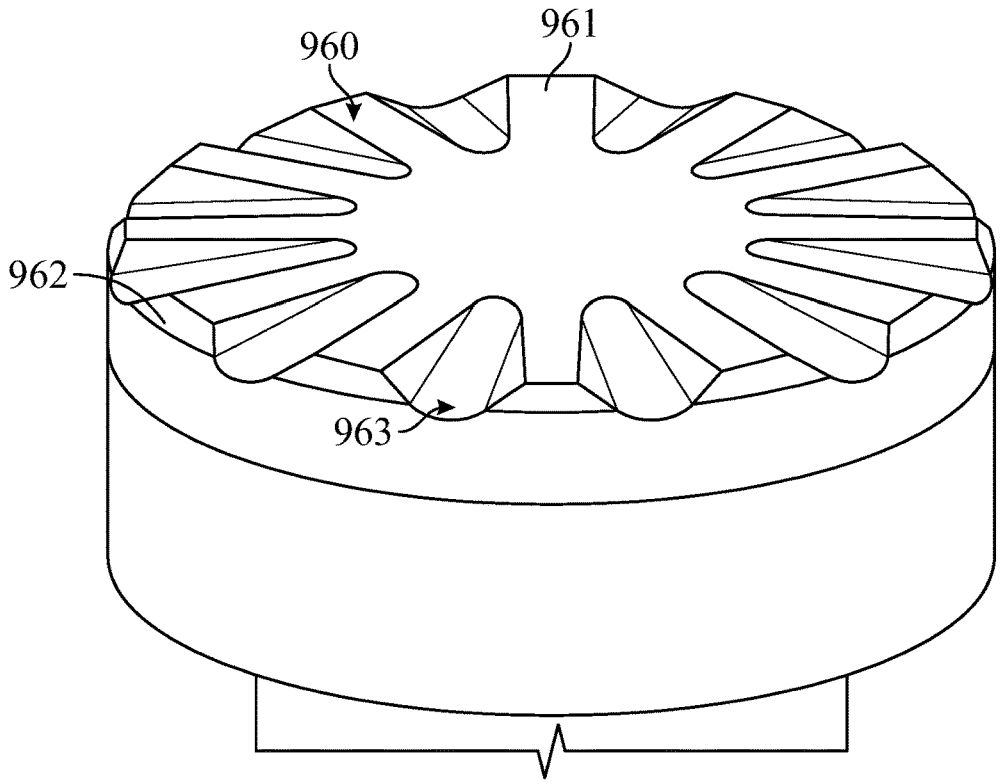
Figure 29:
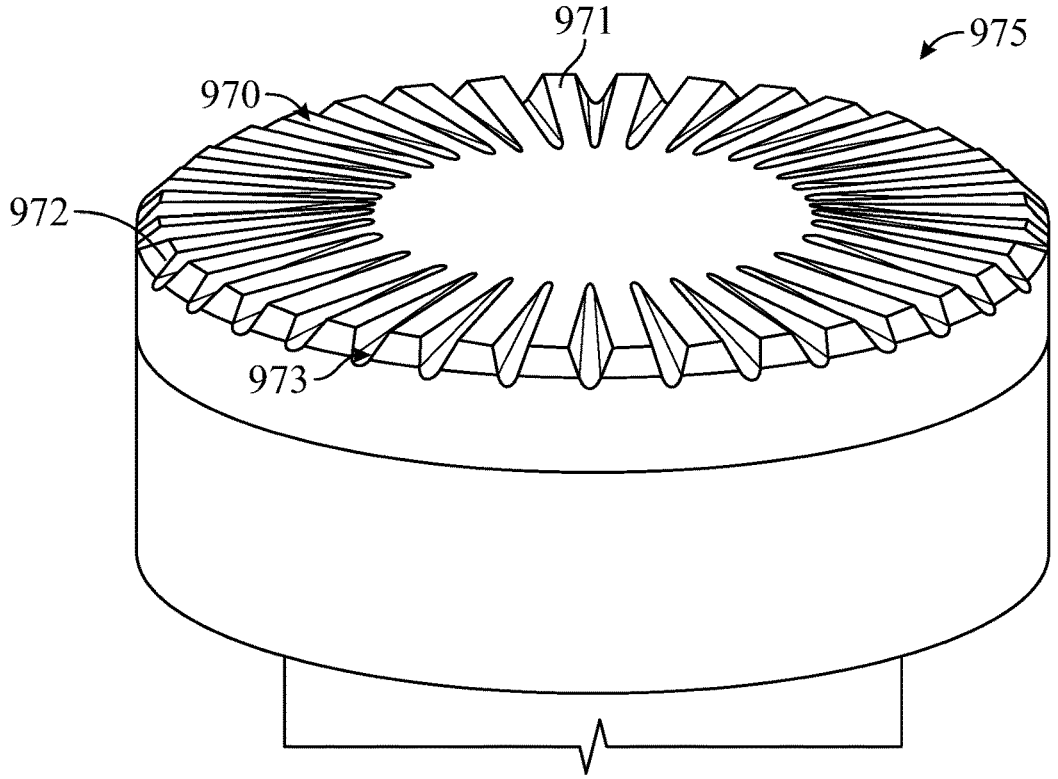

FIGS. 27-29 and 31-32 show examples of different grooved cutting face geometries according to embodiments of the present disclosure, where each of the lobes 950, 960, 970, 980, 990 have a flat top surface 951, 961, 971, 981, 991 geometry, each of the alternating grooves 953, 963, 973, 983, 993 have a rounded base, and a chamfer 952, 962, 972, 982, 992 is formed around the cutting edge. As shown in FIGS. 27-29, the lobe 950, 960, 970 and groove 953, 963, 973 shapes are substantially the same, but have different sizing. For example, the grooves 953, 963, 973 formed between the lobes 950, 960, 970 are each deeper than the chamfer 952, 962, 972, such that the groove base meets the peripheral side of the cutting element at a cutting edge location axially farther from the lobe top surface 951, 961, 971 than the lowest part of the chamfer 952, 962, 972. However, the cutting face geometry in FIG. 29 includes 36 alternating lobes 970 and grooves 973, the cutting face geometry in FIG. 27 includes 24 alternating lobes 950 and grooves 953, and the cutting face geometry in FIG. 28 includes 12 alternating lobes 960 and grooves 963. With all other parameters being equal (e.g., cutting element orientation and workpiece being drilled), the cutting face geometry shown in FIG. 27 may provide increased rotatability than the cutting face geometry shown in FIG. 28 having less alternating lobes 960 and grooves 963, and the cutting face geometry shown in FIG. 29 may provide the highest rotatability when compared with the geometry in FIGS. 28 and 27, where rotatability may be measured in terms of degrees of rotation per second.

Figure 30:
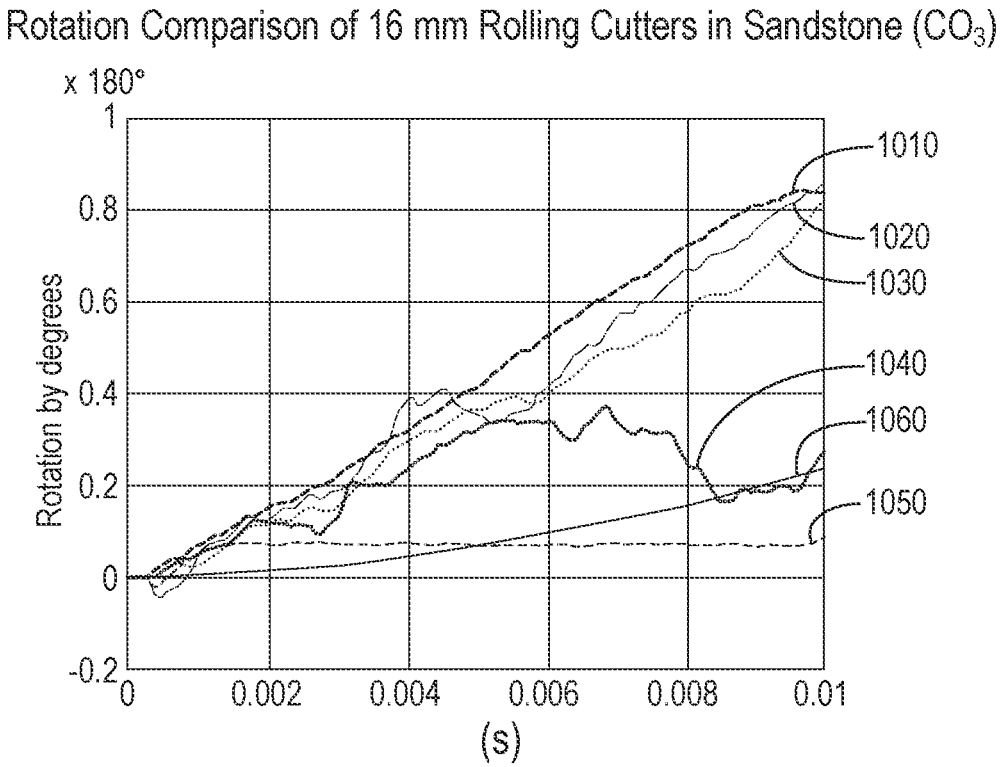
FIGS. 30 and 31 show graphs comparing rotatability of grooved cutting face geometries according to embodiments of the present disclosure with a planar cutting face geometry.

For example, FIG. 30 shows a graph comparing the effects of depth of cut, number of lobes, and lobe top surface geometry on the rotatability of grooved cutting face geometry. The graph compares rotatability of a first grooved cutting face geometry 1010 having 24 lobes with flat top surfaces and cutting at a 0.1 inch depth of cut; a second grooved cutting face geometry 1020 having 12 lobes with flat top surfaces and cutting at a 0.1 inch depth of cut; a third grooved cutting face geometry 1030 having 24 lobes with curved top surfaces and cutting at a 0.1 inch depth of cut; a fourth grooved cutting face geometry 1040 having 12 lobes with curved top surfaces and cutting at a 0.1 inch depth of cut; a fifth grooved cutting face geometry 1050 having 36 lobes with flat top surfaces and cutting at a 0.04 inch depth of cut; and a planar cutting face geometry 1060 (without lobes and grooves formed therein) for a baseline. As seen by the comparison, cutting elements having grooved cutting face geometries with a relatively higher number of lobes may have increased rotatability when compared under the same drilling conditions (e.g., at the same depth of cut and same top surface geometry). When cutting elements having the same grooved cutting face geometries cut at different depths of cut, the rotatability may be increased when cutting at higher depths of cut. Additionally, when cutting elements have the same number of lobes and cut at the same depth of cut, lobes with flat top surface may provide increased rotatability when compared with lobes having curved top surfaces.

Figure 31:
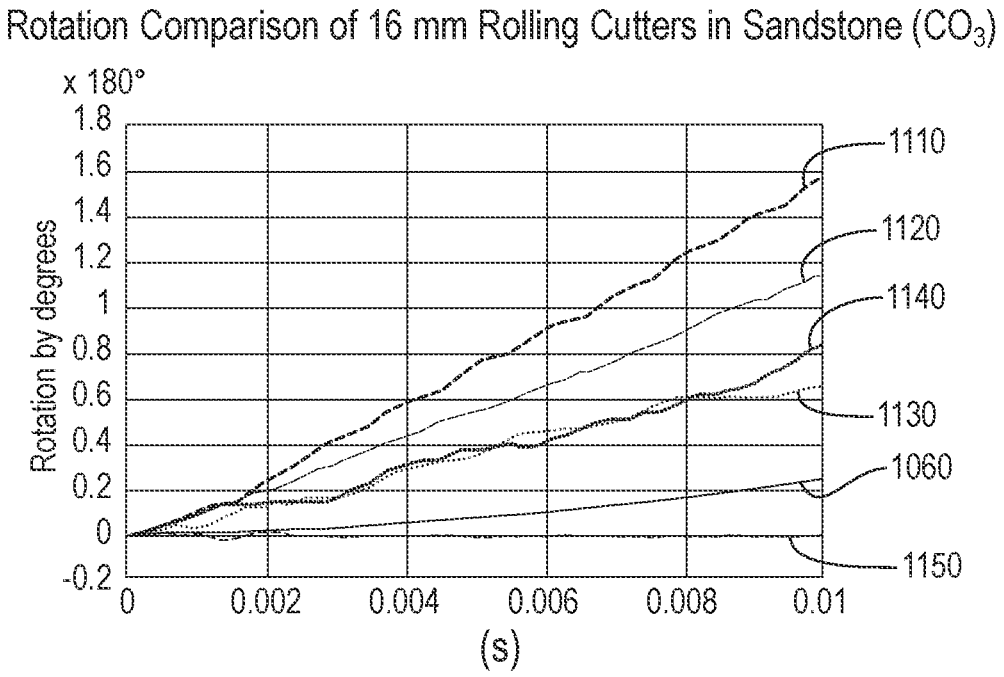

FIG. 31 shows another graph comparing the effects of depth of cut and number of lobes on the rotatability of grooved cutting face geometry, where the lobes have a curved top surface. The graph compares rotatability of a first grooved cutting face geometry 1110 having 36 lobes with curved top surfaces and leaning in a counterclockwise direction, cutting at a 0.04 inch depth of cut; a second grooved cutting face geometry 1120 having 36 lobes with curved top surfaces and cutting at a 0.06 inch depth of cut; a third grooved cutting face geometry 1130 having 36 lobes with curved top surfaces and cutting at a 0.04 inch depth of cut; a fourth grooved cutting face geometry 1140 having 24 lobes with curved top surfaces and cutting at a 0.06 inch depth of cut; a fifth grooved cutting face geometry 1150 having 24 lobes with curved top surfaces and cutting at a 0.04 inch depth of cut; and a planar cutting face geometry 1060 (without lobes and grooves formed therein) for a baseline. As seen by the comparison, cutting elements having grooved cutting face geometries with a relatively higher number of lobes may have increased rotatability when compared under the same drilling conditions (e.g., at the same depth of cut). When cutting elements having the same grooved cutting face geometries cut at different depths of cut, the rotatability may be increased when cutting at higher depths of cut.

Figure 32:
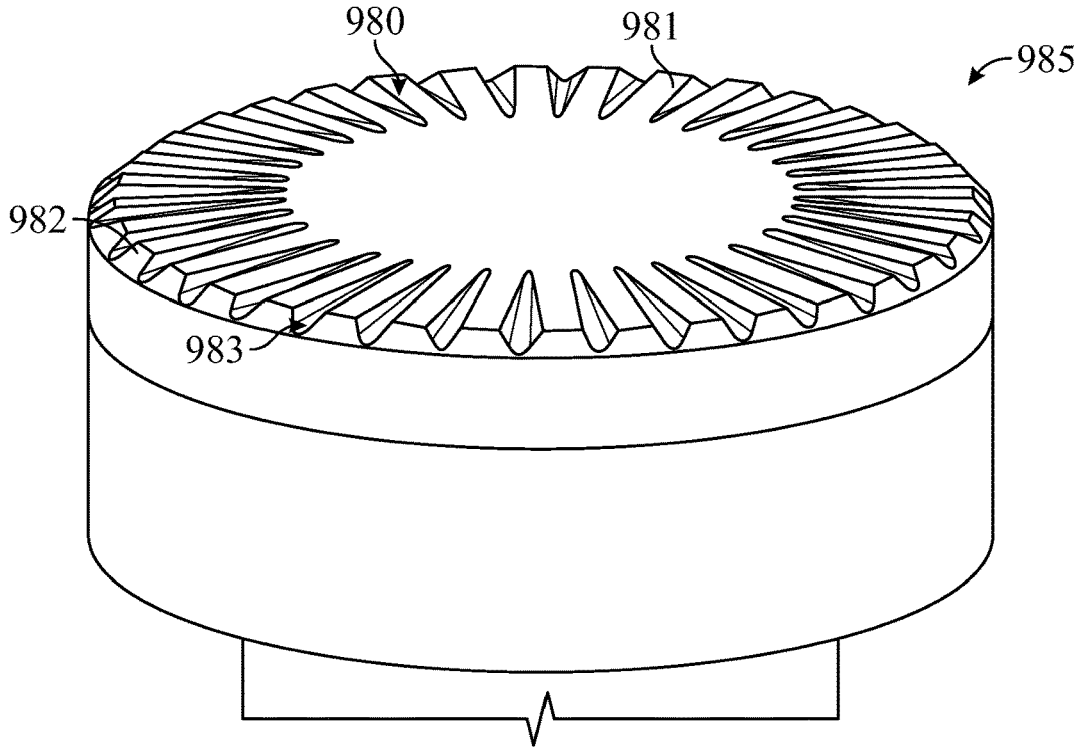
FIGS. 32 and 33 show grooved cutting face geometries according to embodiments of the present disclosure.
Figure 33:
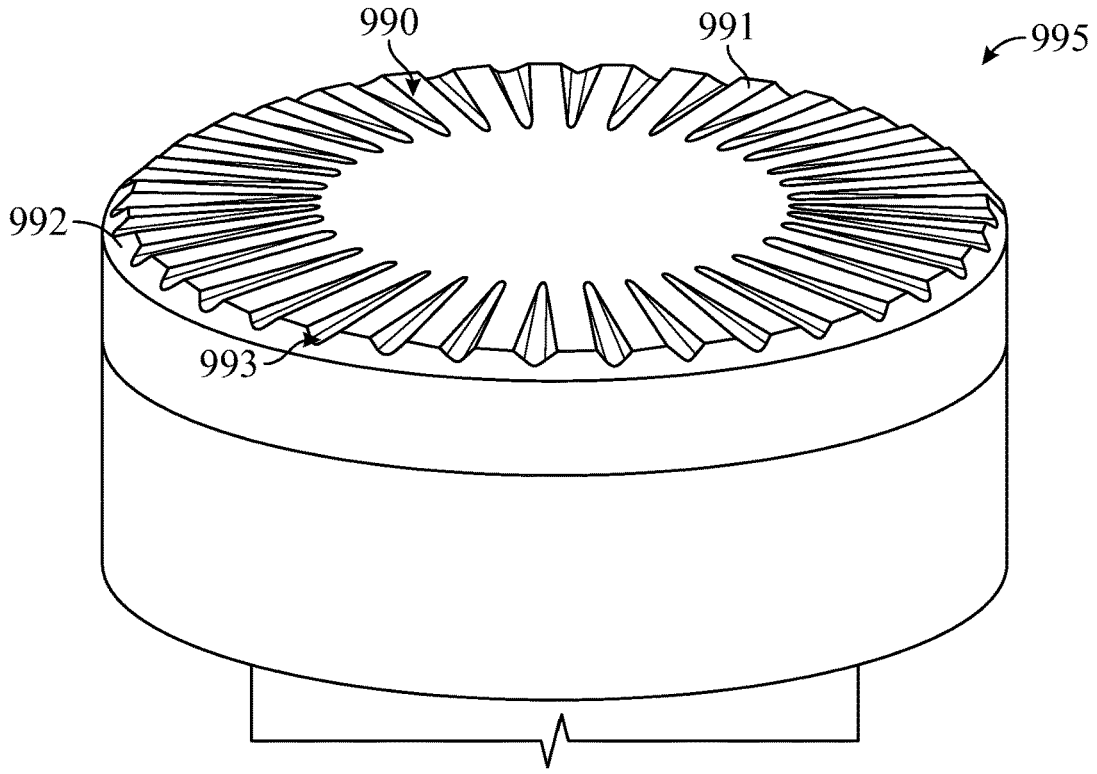

FIGS. 29, 32, and 33 show a comparison of cutting face geometries having different groove depths (i.e., different lobe heights), where substantially all other design parameters may be equal (e.g., same size and shape of the central region, same number of alternating lobes and grooves, same chamfer size, same cutting element size and shape, flat top lobes, and curved groove bases). In FIGS. 29, 32, and 33, the flat top surfaces 971, 981, 991 of the lobes 970, 980, 990 may be coplanar with the planar surface of the central region, such that the top surfaces 971, 981, 991 of the lobes 970, 980, 990 extend along the same plane perpendicular to longitudinal axis of the cutting element as the central region. The bases of the grooves 973, 983, 993 may slope downwardly and outwardly from the central region to different depths, where the grooves 973 in FIG. 29 extend to a depth lower than the entire chamfer 972, the grooves 983 in FIG. 32 extend to a depth proximate to the lowest part of the chamfer 982 but less than the entire chamfer 982 depth, and the grooves 993 in FIG. 33 extend to a depth that may be approximately half of the chamfer 992 depth. Thus, the grooves 973 in FIG. 29 extend to the deepest depth, the grooves 983 in FIG. 32 extend to an intermediate depth, and the grooves 993 in FIG. 33 extend to the shallowest depth. When compared by cutting under the same conditions and in the same orientation, the cutting face geometries in FIGS. 29 and 32 with the deepest grooves 973 and intermediate depth grooves 983 may have a higher rotatability than the cutting face geometry in FIG. 33 with the shallowest grooves 993.

Figure 34:
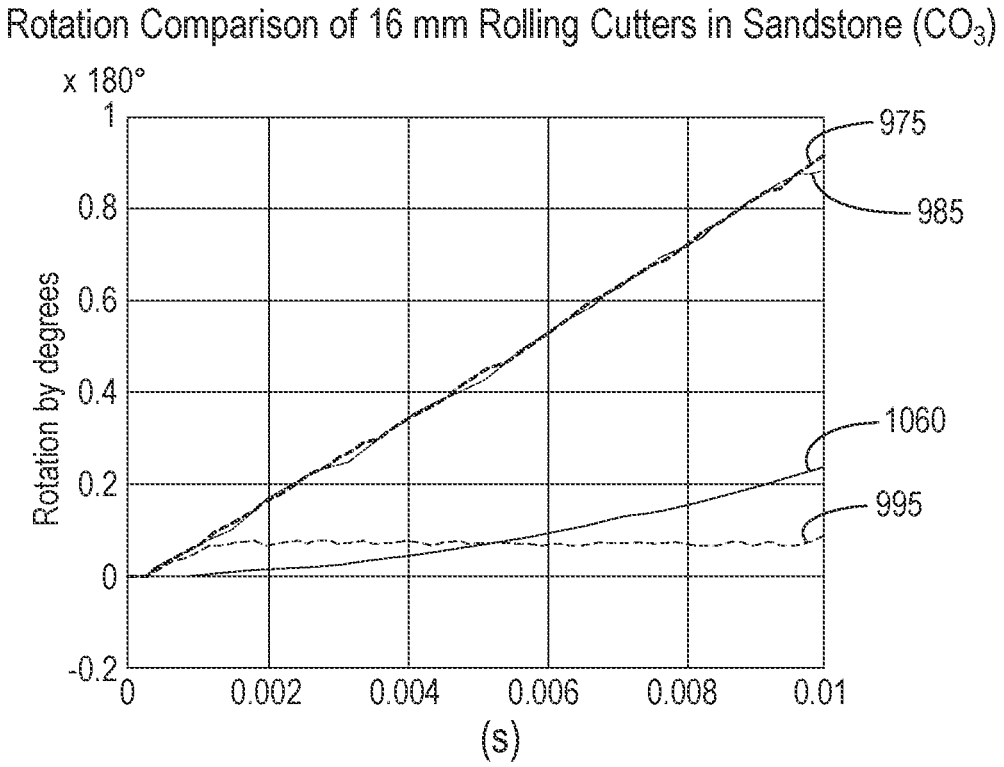
FIGS. 34 and 35 show graphs comparing rotatability of grooved cutting face geometries according to embodiments of the present disclosure with a planar cutting face geometry.

For example, FIG. 34 shows a graph comparing the effects of groove depth in grooved cutting face geometries according to embodiments of the present disclosure on rotatability of the cutting element. The graph compares the grooved cutting face geometry 975 shown in FIG. 29 (with a deepest groove depth), the grooved cutting face geometry 985 shown in FIG. 32 (with an intermediate groove depth), and the grooved cutting face geometry 995 shown in FIG. 33 (with a shallowest groove depth) with a planar cutting face geometry 1060 as a baseline, cutting at a 0.04 inch depth of cut. As shown, grooved cutting face geometries according to embodiments of the present disclosure with relatively deeper grooves may have increased rotatability when compared with grooved cutting face geometry having relatively shallower grooves or when compared with planar cutting face geometries.

Figure 35:
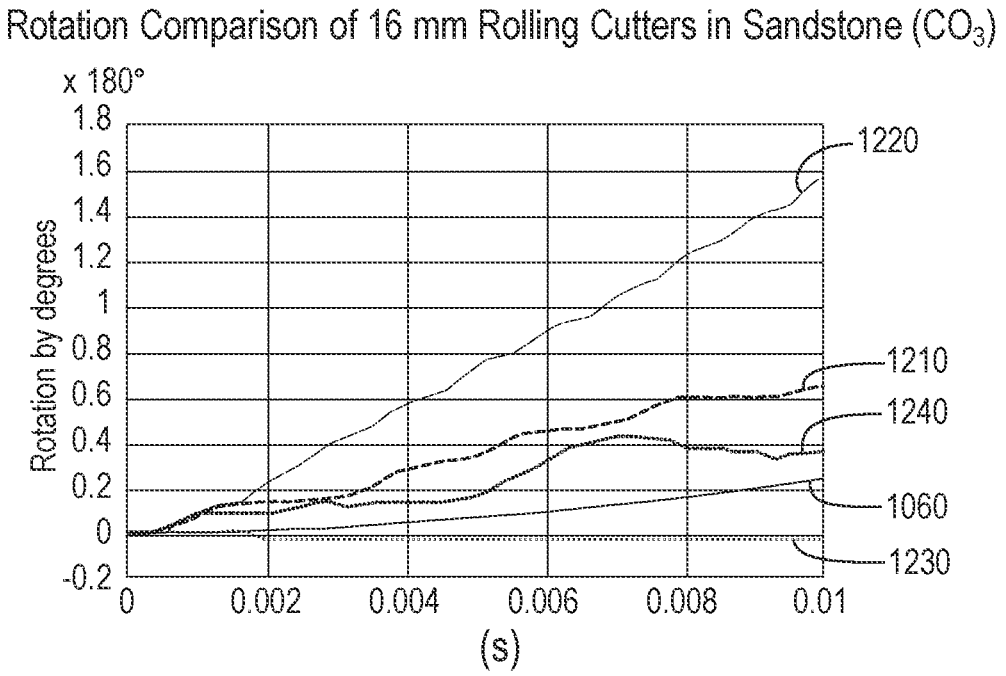

Additionally, by providing lobes that lean in either the clockwise or counterclockwise direction around a cutting face of a rotatable cutting element, the grooved region geometry may enhance rotation of the rotatable cutting element, depending on the placement or orientation of the cutting element on the bit. For example, FIG. 35 shows a graph comparing a first grooved cutting face geometry 1210 having 36 lobes with curved top surfaces that are coplanar with the central region of the cutting face and symmetric about a radial plane bisecting the lobe apex (e.g., as shown in FIG. 18); a second grooved cutting face geometry 1220 having 36 lobes with curved top surfaces that are coplanar with the central region of the cutting face and lean asymmetrically about a radial plane bisecting the lobe apex in a counterclockwise direction (e.g., as shown in FIG. 19); a third grooved cutting face geometry 1230 having 36 lobes with curved top surfaces that are coplanar with the central region of the cutting face and lean asymmetrically about a radial plane bisecting the lobe apex in a clockwise direction (e.g., as shown in FIG. 20); a fourth grooved cutting face geometry 1240 having 8 lobes with curved top surfaces that extend at a positive projection angle from the central region of the cutting face (where the lobes extend axially higher than the central region) and where the groove bases are coplanar with the central region; and a planar cutting face geometry 1060 as a baseline. Each of the cutting face geometries were tested in the same orientation, including the same side rake angle. As shown, the grooved cutting face geometry that had lobes leaning in the direction corresponding to the side rake angle direction had the highest rotatability, while the grooved cutting face geometry that had lobes leaning in the opposite direction had the lowest rotatability. Additionally, grooved cutting face geometry having asymmetrically leaning lobes (in a direction corresponding with the side rake angle direction) had higher rotatability than grooved cutting face geometry with radially symmetric lobes.

Figure 36:
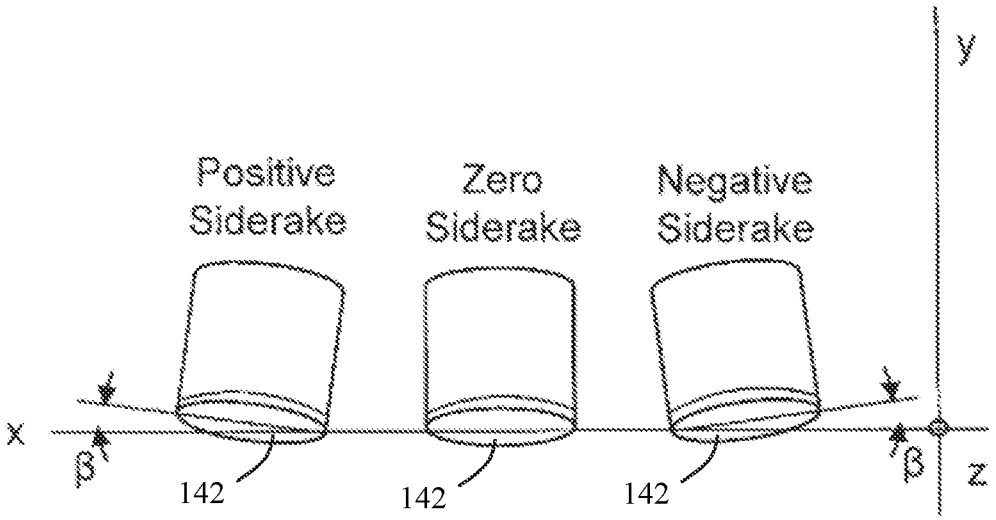
FIGS. 36 and 37 show illustrations of side rake and back rake orientation of cutting elements.

Cutting elements having a grooved cutting face geometry according to embodiments of the present disclosure may be mounted (rotatably mounted or fixedly mounted) to a cutting tool, e.g., a drill bit, at different orientations, including side rake (lateral orientation) and back rake (vertical orientation), with respect to the tool. Conventionally, side rake is defined as the angle between the cutting face 142 and the radial plane of a bit (x-z plane), as illustrated in FIG. 36. When viewed along the z-axis, a negative side rake angle $\beta$ results from counterclockwise rotation of the cutter, and a positive side rake angle $\beta$, from clockwise rotation. Cutting elements having a grooved cutting face geometry according to embodiments of the present disclosure may be mounted to a drill bit at a side rake angle ranging from, for example, 0 to ±45 degrees, ±5 to ±35 degrees, ±10 to ±35 degrees or ±15 to ±30 degrees. Further, rotatable cutting elements according to embodiments of the present disclosure having a grooved cutting face geometry with lobes leaning in the counterclockwise direction (e.g., as shown in FIG. 19) may be mounted at a positive side rake to enhance rotatability, and rotatable cutting elements according to embodiments of the present disclosure having a grooved cutting face geometry with lobes leaning in the clockwise direction (e.g., as shown in FIG. 20) may be mounted at a negative side rake to enhance rotatability.

Figure 37:
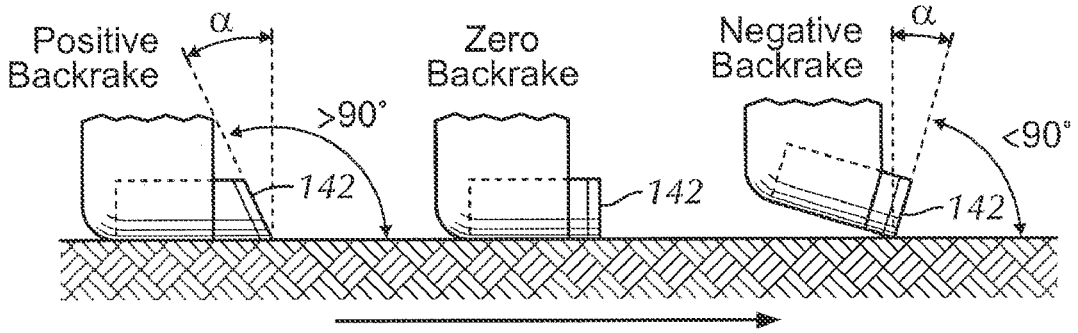

Generally, back rake is defined as the angle $\alpha$ formed between the cutting face 142 of the cutting angle and a line that is normal to the formation material being cut. As shown in FIG. 37, with a conventional cutting element having zero back rake, the cutting face 142 is substantially perpendicular or normal to the formation material. A cutting element having negative back rake angle $\alpha$ has a cutting face 142 that engages the formation material at an angle that is less than 90° as measured from the formation material. Similarly, a cutting element having a positive back rake angle $\alpha$ has a cutting face 142 that engages the formation material at an angle that is greater than 90° when measured from the formation material. Cutting elements having a grooved cutting face geometry according to embodiments of the present disclosure may be rotatably or fixedly mounted to a cutting tool, e.g., a drill bit, at a back rake angle ranging from, for example, 0 to −45 degrees.

Cutting elements having a grooved cutting face geometry disclosed herein may be mounted on a drill bit, or other downhole cutting tool, such as a reamer. For example, according to some embodiments, a drill bit may have a bit body, a central axis extending axially through the bit body, and a plurality of blades extending outwardly from the bit body. A plurality of cutting elements having grooved cutting face geometries may be mounted on the blades. One or more of the cutting elements mounted to the drill bit may include a longitudinal axis extending axially through the cutting element, a grooved cutting face formed at an axial end of the cutting element, a peripheral surface extending circumferentially around the cutting face, and a cutting edge formed between the cutting face and the peripheral surface. The grooved cutting faces may include a central region around the longitudinal axis of the cutting element and a grooved region circumferentially surrounding the central region including a plurality of alternating lobes and grooves (e.g., at least 24 grooves and 24 lobes) extending radially from a boundary of the central region to the cutting edge. Each lobe in the grooved region may have the same geometry including a cross-sectional profile comprising an apex and two opposite side surfaces extending between the apex and adjacent grooves on opposite sides of the lobe.

In some embodiments, the cutting elements may be rotatably mounted to the cutting tool (e.g., on the blades of a drill bit or reamer), such that each cutting element is rotatable about its longitudinal axis. Further, one or more cutting elements may be mounted at a side rake angle and or back rake angle to enhance rotatability of the cutting element. For example, a cutting element with a grooved cutting face according to embodiments of the present disclosure may be rotatably mounted to a drill bit, where the grooved cutting face includes lobes that are asymmetric about a radial plane extending axially through the cutting element and along a radial length of the lobe.

Figure 38:
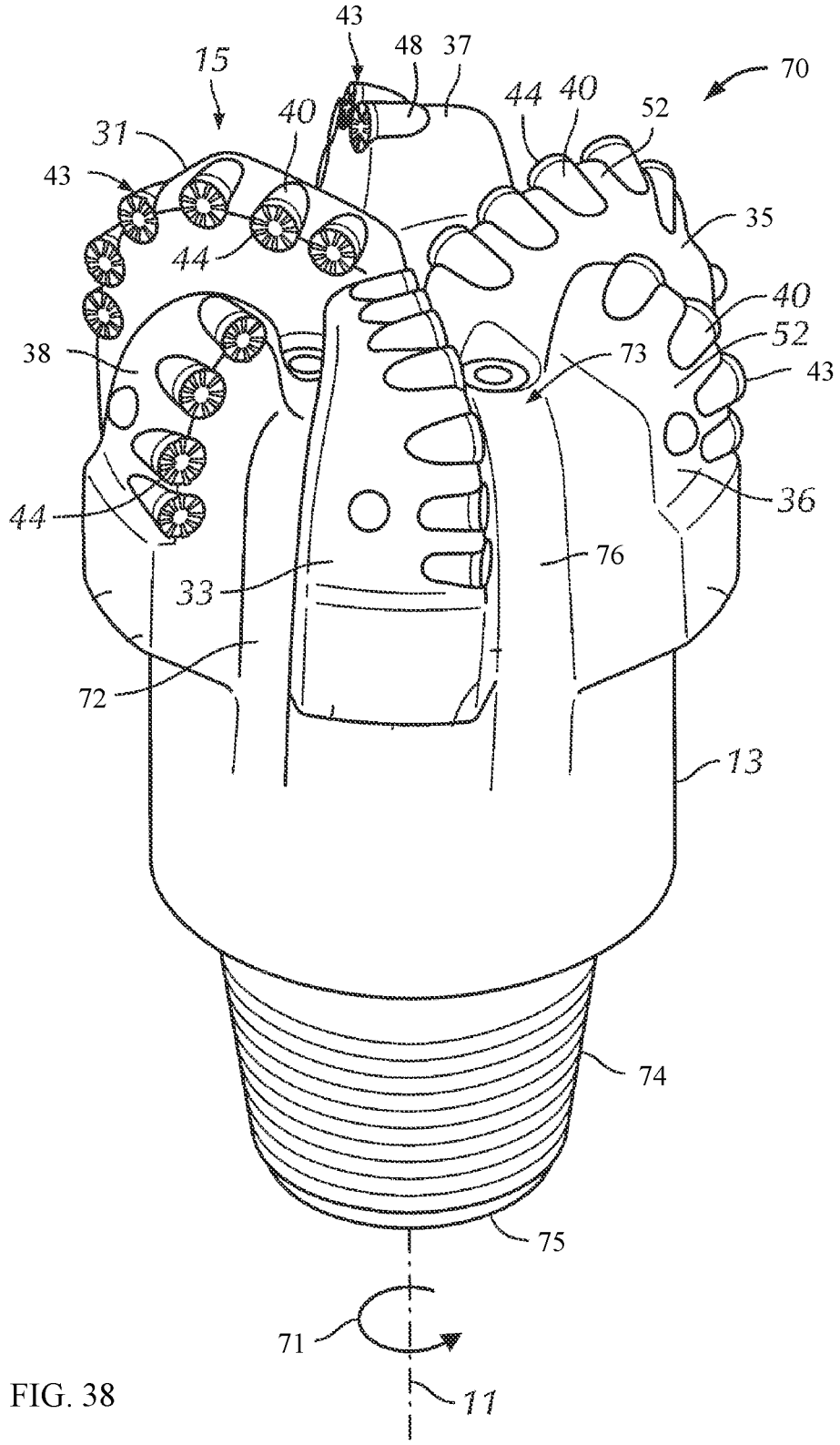
FIG. 38 shows a drill bit according to embodiments of the present disclosure.

FIG. 38 shows an example of a drill bit 70 according to embodiments of the present disclosure, which when rotated in a cutting direction 71 about its central axis 11 may drill through formations of rock to form a borehole. Bit 70 may include a bit body 72, a shank 13, and a threaded connection or pin 74 for connecting the bit 70 to a drill string (not shown) that is employed to rotate the bit in order to drill the borehole. Bit face 73 supports a cutting structure 15 and is formed on the end of the bit 70 that is opposite pin end 75.

The cutting structure 15 may be provided on the face 73 of the bit 70, and may include a plurality of angularly spaced-apart primary blades 31, 33, 35 and secondary blades 36, 37, 38 each of which extends outwardly from bit face 73. Primary blades 31, 33, 35 and secondary blades 36, 37, 38 may extend generally radially along bit face 73 and then axially along a portion of the periphery of bit 70. The secondary blades 36, 37, 38 may extend radially along bit face 73 from a position that relatively farther from the axis 11 than the primary blades and extend toward the periphery of bit 70. The primary blades 31, 33, 35 and secondary blades 36, 37, 38 are separated by drilling fluid flow courses 76.

The blades 31, 33, 35, 36, 37, 38 may each include a blade top 52 (e.g., the radially outermost surface of the blade) for mounting a plurality of cutting elements 40 having a grooved cutting face geometry according to embodiments of the present disclosure. In particular, cutting elements 40, each having a grooved cutting face 44 geometry according to embodiments disclosed herein, may be mounted in pockets formed in the blade tops 52 of the blades. Cutting elements 40 may be arranged adjacent one another in a radially extending row proximal the leading edge of each blade 31, 33, 35, 36, 37, 38. The cutting elements 40 may have a cutting edge 43 formed around the cutting face 44, which may protrude from the blade tops 52 to which cutting element 40 is mounted.

Further, the cutting elements 40 may be rotatably mounted to the blades of the bit 70, for example, by rotatably retaining the cutting elements 40 in an outer support element 48 and attaching the outer support element 48 to pockets formed in the blades (e.g., by brazing or welding the outer support element 48 to the blade). In some embodiments, the cutting elements 40 may be directly rotatably mounted within pockets formed in the blades, for example, by positioning a top piece of an outer support element over a portion of the cutting face 44, where the top piece may be attached to the blade and axially retain the cutting element 40 within the pocket.

In embodiments where the cutting elements 40 are rotatably mounted to a bit 70, the cutting elements 40 may be selected to have grooved cutting face geometries that may enhance rotatability. Additionally, the rotatable cutting elements 40 may be oriented on the blades, for example, at selected side rakes, back rakes, and depth of cut, that may improve rotatability, such as disclosed herein.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A cutting element comprising:
- a longitudinal axis extending axially through the cutting element;
- a cutting face at an axial end of the cutting element;
- a peripheral surface extending circumferentially around the cutting face; and
- a cutting edge formed between the cutting face and the peripheral surface;
- wherein the cutting face has a non-planar geometry comprising:
  - a central region around the longitudinal axis of the cutting element;
  - a plurality of grooves extending radially from a boundary of the central region to the cutting edge, wherein each groove has a base with a curved cross-sectional profile;
  - a plurality of lobes alternatingly formed between the plurality of grooves, wherein each lobe has a cross-sectional profile comprising an apex and opposite side surfaces sloping downwardly a distance from the apex to the base of adjacent grooves;
  - an apex width measured along a plane perpendicular to the longitudinal axis and between points of transition from the apex to the opposite side surfaces, wherein the apex width is uniform along a radial length from the boundary of the central region to the cutting edge; and
  - a base width measured along a plane perpendicular to the longitudinal axis and between points of transition from the base to the opposite side surfaces, wherein the base width is uniform along the radial length,
  - wherein the distance of the side surfaces between the apexes and the bases of adjacent lobes and adjacent grooves varies along the radial length.

2. The cutting element according to claim 1, wherein each lobe cross-sectional profile further comprises curved transition surfaces extending between the apex and the opposite side surfaces of the lobe.

3. The cutting element according to claim 1, wherein the apex is a rounded apex comprising a convex surface when viewed in the cross-sectional profile.

4. The cutting element of claim 1, wherein each lobe has a cross-sectional profile comprising:
- a height measured along an axial dimension from the base of an adjacent groove to the apex of the lobe; and
- a width measured perpendicular to the height, at a midpoint of the height, and between the opposite side surfaces of the lobe;
- wherein a height to width ratio of the lobe measured proximate the cutting edge ranges between 1:10 and 1:1.

5. The cutting element of claim 4, wherein the width of each lobe is uniform along an entire radial length of the lobe.

6. The cutting element of claim 1, wherein the apex extends a radial length from the boundary of the central region at a projection angle, wherein the projection angle is measured between a horizontal plane extending perpendicular to the longitudinal axis and a line tangent to and extending the radial length of the apex.

7. The cutting element of claim 6, wherein the projection angle is less than 0 degrees, such that a height of the lobe is greater at a radial location proximate the boundary of the central region than proximate the cutting edge.

8. The cutting element of claim 1, wherein the central region is coplanar with the apexes of the lobes.

9. The cutting element of claim 1, wherein the cutting edge comprises a chamfer, and the apex of each lobe extends a radial length from the boundary of the central region to the chamfer.

10. The cutting element according to claim 1, further comprising:
- a polycrystalline diamond layer mounted to a substrate,
- wherein the cutting face is formed on an upper surface of the polycrystalline diamond layer; and
- wherein the polycrystalline diamond layer and substrate form an inner rotatable cutting element; and
- an outer support element at least partially surrounding the inner rotatable cutting element.

11. The cutting element of claim 1, wherein the cutting face is formed on an upper surface of a polycrystalline diamond layer, and wherein the polycrystalline diamond layer comprises:
- a microstructure comprising a plurality of bonded together diamond grains;
- an unleached region comprising a metal binder disposed in interstitial regions formed between the bonded together diamond grains;
- a leached region that is substantially free of the metal binder; and
- a leaching line defined between the leached region and the unleached region, wherein the leaching line has an undulating profile corresponding to the non-planar geometry of the cutting face.

12. A drill bit comprising:
- a bit body having a central axis extending axially through the bit body;
- a plurality of blades extending outwardly from the bit body; and
- a plurality of cutting elements mounted on the blades, wherein each cutting element comprises:
  - a longitudinal axis extending axially through the cutting element;
  - a cutting face at an axial end of the cutting element;
  - a peripheral surface extending circumferentially around the cutting face; and
  - a cutting edge formed between the cutting face and the peripheral surface;
  - wherein the cutting face has a non-planar geometry comprising:
    - a central region around a longitudinal axis of the cutting element;
    - a plurality of grooves extending radially from a boundary of the central region to the cutting edge, wherein each groove has a base with a curved cross-sectional profile;

a plurality of lobes alternatingly formed between the grooves, wherein each lobe has a cross-sectional profile comprising an apex and opposite side surfaces sloping downwardly a distance from the apex to the base of adjacent grooves;

an apex width measured along a plane perpendicular to the longitudinal axis and between points of transition from the apex to the opposite side surfaces, wherein the apex width is uniform along a radial length from the boundary of the central region to the cutting edge; and a base width measured along a plane perpendicular to the longitudinal axis and between points of transition from the base to the opposite side surfaces, wherein the base width is uniform along the radial length, wherein the distance of the side surfaces between the apexes and the bases of adjacent lobes and adjacent grooves varies along the radial length.

13. The drill bit of claim 12, wherein the plurality of cutting elements each have a longitudinal axis, and wherein the plurality of cutting elements are rotatably mounted to the blades, such that each cutting element is rotatable about the longitudinal axis thereof.

14. The drill bit of claim 13, wherein at least one cutting element of the plurality of cutting elements is mounted at a side rake angle, and wherein the plurality of lobes of the at least one cutting element are asymmetric about a radial plane extending axially through the at least one cutting element and along a radial length of a lobe of the plurality of lobes.

* * * * *